US006334803B1

(12) United States Patent
Shibata

(10) Patent No.: US 6,334,803 B1
(45) **Date of Patent: *Jan. 1, 2002**

(54) METHOD OF MANUFACTURING ELECTRON-EMITTING DEVICE, ELECTRON SOURCE AND IMAGE-FORMING APPARATUS USING THE SAME

(75) Inventor: Masaaki Shibata, Kanagawa-ken (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/846,187

(22) Filed: Apr. 28, 1997

(30) Foreign Application Priority Data

Apr. 26, 1996 (JP) ..... 8-107625
Apr. 25, 1997 (JP) ..... 9-108739

(51) Int. Cl.[7] ..... H01J 9/02
(52) U.S. Cl. ..... 445/51; 445/6; 427/78
(58) Field of Search ..... 445/24, 51, 6; 427/78

(56) References Cited

U.S. PATENT DOCUMENTS 5,591,061 A * 1/1997 Ikeda et al. ..... 445/51 X
5,597,338 A * 1/1997 Iwai et al. ..... 445/51
5,674,100 A * 10/1997 Ono et al. ..... 445/51 X

FOREIGN PATENT DOCUMENTS

| | | | |
|---|---|---|---|
| EP | 0660359 | 6/1995 | ..... H01J/9/02 |
| EP | 0693766 | 1/1996 | ..... H01J/1/30 |
| EP | 0696813 | 2/1996 | |
| EP | 0736890 | 10/1996 | ..... H01J/1/30 |
| EP | 0740324 | 10/1996 | ..... H01J/9/02 |
| JP | 64-19657 | 1/1989 | |
| JP | 64-19658 | 1/1989 | |
| JP | 6-12997 | 1/1994 | |
| JP | 7235255 | 9/1995 | ..... H01J/1/30 |

OTHER PUBLICATIONS

Advances in Electronics and Electron Physics, vol. 8, 1956, pp. 90–185, W. P. Dyke et al., "Field Emission".
Journal of Applied Physics, vol. 47, No. 12, pp. 5248–5263, Dec. 1976, C.A. Spindt et al., "Physical Properties of Thin–Film Field Emission Cathodes with Molybdenum Cones".
Journal of Applied Physics, vol. 32, No. 4, pp. 646–652, Apr. 1961, C. A. Mead, "Operation of Tunnel–Emission Devices".
Radio Engineering and Electronic Physics, Jul. 1965, pp. 1290–1296, M. L. Elinson et al. "The Emission of Hot Electrons and the Field Emission of Electrons from Tin Oxide".

* cited by examiner

*Primary Examiner*—Kenneth J. Ramsey
(74) *Attorney, Agent, or Firm*—Fitzpatrick, Cella, Harper & Scinto

(57) ABSTRACT

A surface conduction electron-emitting device has an electroconductive film including an electron-emitting region between a pair of electrode on a substrate. The electroconductive film is formed by producing a precursor film of an organic metal compound or complex thereof and then turning the precursor film into the electroconductive film by keeping the temperature of the film above the decomposition temperature of the organic metal compound or the complex thereof and applying a voltage to the film. A plurality of such electron-emitting devices are arranged on a substrate in a matrix or ladder-like manner to constitute an electron source. Such an electron source is used with an image-forming member disposed vis-a-vis the electron source to form an image-forming member.

33 Claims, 18 Drawing Sheets

METHOD OF MANUFACTURING ELECTRON-EMITTING DEVICE, ELECTRON SOURCE AND IMAGE-FORMING APPARATUS USING THE SAME

BACKGROUND OF THE INVENTION

1. Field of the Invention

This invention relates to a method of manufacturing an electron-emitting device, a method of manufacturing an electron source and a method of manufacturing an image-forming apparatus comprising such an electron source.

2. Related Background Art

There have been known two types of electron-emitting device; the thermoelectron emission type and the cold cathode electron emission type. Of these, the cold cathode emission type refers to devices including field emission type (hereinafter referred to as the FE type) devices, metal/insulation layer/metal type (hereinafter referred to as the MIM type) electron-emitting devices and surface conduction electron-emitting devices.

Examples of FE type device include those proposed by W. P. Dyke & W. W. Dolan, "Field emission", Advances in Electron Physics, 8, 89 (1956) and C. A. Spindt, "Physical Properties of thin-film field emission cathodes with molybdenum cones", J. Appl. Phys., 47, 5248 (1976).

Examples of MIM device are disclosed in papers including C. A. Mead, "Operation of Tunnel-Emission Devices", J. Appl. Phys., 32, 646 (1961).

Examples of surface conduction electron-emitting device include one proposed by M. I. Elinson, Radio Eng. Electron Phys., 10 (1965).

Known image-forming apparatus utilizing cold cathode type electron-emitting devices include flat type electron beam display panels realized by arranging an electron source substrate carrying thereon a large number of electron-emitting devices and an anode substrate provided with a transparent electrode and a fluorescent body vis-a-vis and in parallel with each other within an envelope and evacuating the envelope.

I. Brodie, "Advanced technology: flat cold-cathode CRT's", Information Display, 1/89, 17 (1989) describes an image-forming apparatus comprising field emission type electron-emitting devices.

On the other hand, Japanese Patent Application Laid-Open No. 7-235255 discloses an image-forming apparatus comprising surface conduction electron-emitting devices.

When compared with currently popular cathode ray tubes (CRTs), flat type electron beam display panels are more adapted for light weight and large screen image-forming apparatus. They can provide bright and high quality images than other known flat type display panels including those utilizing liquid crystal, plasma display panels and electroluminescent display panels.

Now, a known surface conduction electron-emitting device and a method of manufacturing such a device as well as a display panel comprising such devices and a method of manufacturing the same as disclosed in the above cited Japanese Patent Application Laid-Open No. 7-235255 will be briefly summarized below.

FIG. 18 of the accompanying drawings schematically illustrates a surface conduction electron-emitting device of the type under consideration. Referring to FIG. 18, it comprises a substrate 1, a pair of device electrodes 2 and 3 and an electroconductive thin film 4, which thin film is typically a palladium thin film formed by baking a film of an organic palladium compound. An electron-emitting region 5 will be produced therein when subjected to a current conduction process referred to as energization forming, which will be described hereinafter.

Conventionally, the electroconductive thin film 4 of a surface conduction electron-emitting device is subjected to energization forming in order to produce an electron-emitting region 5 before the device is put to use for electron emission. In an energization forming process, a constant DC voltage or a slowly rising DC voltage that rises very slowly typically at a rate of 1 V/min. is applied to given opposite ends of the electroconductive film 4 to partly destroy, deform or transform the film and produce an electron-emitting region 5 which is electrically highly resistive. Thus, the electron-emitting region 5 is part of the electroconductive film 4 that typically contains a fissure or fissures therein so that electrons may be emitted from the area including the fissure(s) and its vicinity. Note that, once subjected to an energization forming process, a surface conduction electron-emitting device comes to emit electrons from its electron emitting region 5 whenever an appropriate voltage is applied to the electroconductive film 4 to make an electric current run through the device.

After the energization forming process, the device is preferably subjected to an activation process, which is a process for remarkably changing the device current If and the emission current Ie of the device.

An activation process is typically conducted by repetitively applying an appropriate pulse voltage to the electron-emitting region in an atmosphere containing gaseous organic substances. As a result of this process, carbon or a carbon compound arising from the organic substances contained in the atmosphere is deposited on the device to remarkably change the device current If and the emission current Ie.

On the other hand, a display panel to be used for an image-forming apparatus can be prepared by placing an electron source substrate carrying thereon a large number of electron-emitting devices that are arranged in the form of a matrix or parallel ladders and a face plate provided with a fluorescent body adapted to emit light when irradiated with electrons emitted from the electron source substrate and, if necessary, a control electrode vis-a-vis and in parallel with each other within a vacuum envelope.

FIG. 19 of the accompanying drawings schematically illustrates a display panel comprising an electron source realized by arranging surface conduction electron-emitting devices in the form of a matrix. In FIG. 19, the electron source comprises an electron source substrate 201 carrying thereon a plurality of electron-emitting devices, a rear plate 202 rigidly holding the electron source substrate 201 and a face plate 203 realized by arranging a fluorescent film 204 and a metal back 205 on the inner surface of a glass substrate. Reference numeral 206 denotes a support frame to which the rear plate 202 and the face plate 203 are bonded by means of frit glass. Reference numeral 207 denotes a vacuum envelope provided with terminals Dox1 through Doxm and Doy1 through Doyn arranged in correspondence to the matrix of wires in the electron source and a high voltage terminal 208.

A display panel as described above can be made to emit electrons from selected electron-emitting devices arranged on the electron source substrate in a simple matrix arrangement by selectively applying a drive pulse voltage to them. A DC voltage as high as 1 to 10kV is applied to the high voltage terminal 208 in order to satisfactorily energize the fluorescent body relative to the electron beams emitted from the devices.

An image-forming apparatus capable of displaying highly bright images with high quality can be realized by combining a display panel comprising surface conduction electron-emitting devices and an appropriate drive circuit in a manner as described above.

As discussed above, with any typical known method of manufacturing a surface conduction electron-emitting device, an electron-emitting region 5 is normally produced by subjecting the electroconductive thin film 4 to an energization forming process. This process consumes a considerable amount of electricity for electrically energizing the electroconductive thin film. When preparing a large number of surface conduction electron-emitting devices on a common substrate, it is preferable that a relatively large number of them are subjected to energization forming simultaneously in a single operation (for example, on a row by row basis) but the number may inevitably be limited if each device consumes a considerable amount of electricity for energization forming. This problem has so far been avoided by reducing the thickness of the electroconductive thin film 4 and/or by using a film comprising fine particles for the electroconductive thin film 4 in order to reduce the power consumption rate.

In other words, an ultrathin film or a fine particle film to be used as the electroconductive thin film of a surface conduction electron-emitting device has an advantage that it consumes little power for energization forming because it is fused and aggregated at temperatures lower than the melting point of a bulk of the material of the electroconductive film.

On the other hand, the process of manufacturing a display panel comprising surface conduction electron-emitting devices involves a heating step as described below after the formation of an electroconductive thin film in each device.

Firstly, the envelope 207 of the display panel is a container comprising a rear plate 202, a face plate 203 and a support frame 206 that has to be exhausted in order to produce a vacuum condition in the inside. Thus, these components are typically bonded together by means of frit glass but this bonding operation requires that the frit glass is baked in ambient air or in a nitrogen atmosphere within a temperature range between 400 and 500° C. for more than ten minutes.

Additionally, a display panel of the type under consideration is normally operated for image display by applying a high voltage between the electron source substrate 201 and the fluorescent film 204 arranged on the face plate 203, which are separated only by a short distance between 1 and 10 mm in order to avoid any undesired spread of electron beams. In other words, the intensity of the electric field between the electron source substrate 201 and the fluorescent film 204 will be as high as between $10^{-6}$ and $10^{-7}$ V/m when a voltage of 10 kV is applied to the fluorescent film.

When the surface conduction electron-emitting devices are driven to operate under such an intense electric field, undesired phenomena such as abnormal electric charging and discharging can appear to destroy, in certain cases, some of the devices as residual molecules are ionized in the envelope 207 if the pressure in the envelope 207 is not held sufficiently low.

Particularly, the inside of the envelope 207 can become contaminated, at least temporarily, by the gaseous organic substance introduced into the envelope 207 for the activation process.

Therefore, the envelope 207 is preferably baked out at a temperature, for example, between 300 and 400° C. for more than ten hours before it is hermetically sealed.

Thus, the components of the surface conduction electron-emitting devices need to show a sufficient resistance against heat in such a long heating operation conducted at temperatures as high as 400 or 500° C. in some instances. However, such a dual requirement of thermal resistance and reduced power consumption for energization forming has hardly been met to date.

Under the above described circumstances, there has been a demand for a method of manufacturing a surface conduction electron-emitting device that can produce an electron-emitting region 5 within the electroconductive thin film 4 that is thermally highly resistive for the heating step with a low power consumption rate during the energization forming step.

SUMMARY OF THE INVENTION

In view of the above identified problems, it is therefore an object of the present invention to provide a method of manufacturing a surface conduction electron-emitting device that operates excellently for electron emission during a prolonged service life, a method of manufacturing an electron source comprising such surface conduction electron-emitting devices and a method of manufacturing an image-forming apparatus using such an electron source.

As a result of intensive research efforts, the inventors of the present invention achieved the present invention.

According to an aspect of the invention, there is provided a method of manufacturing an electron-emitting device having an electroconductive film including an electron-emitting region and a pair of device electrodes disposed opposite to each other and electrically connected to the electroconductive film, characterized in that it comprises steps of (a) producing a film of an organic metal compound or a complex thereof as a precursor of the material of the electroconductive film to link the device electrodes and (b) turning the film of the organic metal compound or the complex thereof, whichever appropriate, into an electroconductive film including an electron-emitting region by keeping the temperature of the film above the decomposition temperature of the organic metal compound or the complex thereof and applying a voltage to the film of the organic metal compound or the complex thereof by way of the device electrodes.

Alternatively, a method of manufacturing an electron-emitting device according to the invention is characterized in that it comprises steps of forming a first electroconductive film, forming a fissure in part of the first electroconductive film, subsequently producing a film of an organic metal compound or a complex thereof on the first electroconductive film and turning the film of the organic metal compound or the complex thereof, whichever appropriate, into a second electroconductive film including an electron-emitting region by keeping the temperature of the film above the decomposition temperature of the organic metal compound or the complex thereof and applying a voltage to the film of the organic metal compound or the complex thereof by way of the device electrodes. For the purpose of the invention, a pulse voltage may be applied to the device electrodes in the step of forming a fissure in the first electroconductive film.

In a broader scope, a method of manufacturing an electron-emitting device according to the invention is characterized in that it comprises steps of forming at least a pair of device electrodes, forming a film of an organic metal compound or a complex thereof and electrically energizing and baking the film of the organic metal compound or the complex thereof and subjecting the film to an activation process. In a preferred mode of carrying out the invention, the step of electrically energizing and baking the film of organic metal compound or the complex thereof is conducted in an oxidizing atmosphere and the subsequent step of subjecting the film to an activation process is conducted in an organic substance containing atmosphere. In another preferred mode of carrying out the invention, the step of electrically energizing and baking the film of organic metal compound or the complex thereof is conducted in an inert gas containing atmosphere or in vacuum to incorporate the subsequent activation step in it. Alternatively, the step of electrically energizing and baking the film of organic metal compound or the complex thereof is conducted in an organic substance containing atmosphere to incorporate the subsequent activation step in it.

The present invention also relates to a method of manufacturing an electron source as well as to a method of manufacturing an image-forming apparatus comprising such an electron source.

In another aspect of the invention, there is provided a method of manufacturing an electron source comprising a plurality of electron-emitting devices arranged on a substrate, each having an electroconductive film including an electron-emitting region and a pair of device electrodes disposed opposite to each other and electrically connected to the electroconductive film, characterized in that the electron-emitting devices are prepared by means of any of the above described method of manufacturing an electron-emitting device.

In still another aspect of the invention, there is provided a method of manufacturing an image-forming apparatus comprising an electron source and an image-forming member for emitting rays of light to produce an image as it is irradiated with electron beams emitted from the electron source, said electron source and said image-forming member being contained in a vacuum container, characterized in that the electron source is prepared by the above described method of manufacturing an electron source.

In a further aspect of the invention, there is provided an electron-emitting device manufactured by a method of manufacturing an electron-emitting device according to the invention.

An electron-emitting device according to the invention comprises an electroconductive film including an electron-emitting region, a pair of device electrodes disposed opposite to each other and electrically connected to the electroconductive film and a coating film containing carbon as principal ingredient and covering the electron-emitting region, and is characterized in that the electric resistance of the electroconductive film does not irreversibly increase if its temperature is raised from room temperature to 500° C. Preferably, the thermal aggregation temperature of the electroconductive film is not lower than 500° C.

Alternatively, an electron-emitting device according to the invention comprises an electroconductive film including an electron-emitting region, a pair of device electrodes disposed opposite to each other and electrically connected to the electroconductive film and a coating film containing carbon as principal ingredient and covering the electron-emitting region, and is characterized in that the electric resistance of the film laminate does not irreversibly increase if its temperature is raised from room temperature to 500° C. Preferably the thermal aggregation temperature of at least one of the layers of the film laminate except the lowermost layer is not lower than 500° C.

In a still further aspect of the invention, there are provided an electron source and an image-forming apparatus.

An electron source according to the invention is characterized in that it comprises a plurality of electron-emitting devices according to the invention and wires for electrically connecting the devices arranged on a substrate.

An image-forming apparatus according to the invention is characterized in that it comprises an electron source according to the invention and an image-forming member for emitting rays of light to produce an image as it is irradiated with electron beams emitted from the electron source, said electron source and said image-forming member being contained in a vacuum container.

With a method of manufacturing an electron-emitting device according to the invention, there is realized an electron-emitting device that stably maintains its electron emitting performance for a long period of time.

With a method of manufacturing an electron source according to the invention, there is realized an electron source that also stably maintains its electron emitting performance for a long period of time.

With a method of manufacturing an image-forming apparatus according to the invention, there is realized an image-forming apparatus that stably maintains its image forming performance for a long period of time.

DESCRIPTION OF THE PREFERRED EMBODIMENTS

Now, the present invention will be described in greater detail by referring to the accompanying drawings that illustrate preferred modes of carrying out the invention.

FIGS. 1A, 1B, 1C and 1D schematically illustrate different steps of manufacturing a surface conduction electron-emitting device in a preferred mode of carrying out the invention.

Referring to FIGS. 1A, 1B, 1C and 1D, there are shown a substrate 1, a pair of device electrodes 2 and 3, a film 4*a* made of an organic metal compound or a complex thereof, an electroconductive film 4*b* produced by chemically decomposing the film 4*a* made of an organic metal compound or a complex thereof and an electron-emitting region 5.

Figure 1A:
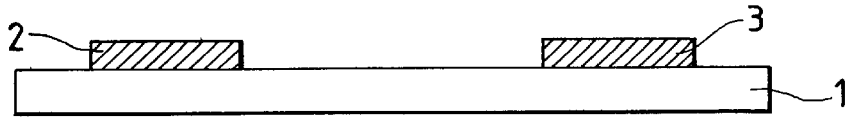
FIGS. 1A, 1B, 1C and 1D schematically illustrate different steps of manufacturing a surface conduction electron-emitting device in a preferred mode of carrying out the invention.

1) After thoroughly cleansing a substrate 1 with detergent, pure water and organic solvent, a material for forming device electrodes is deposited on the substrate 1 by means of vacuum evaporation, sputtering or some other appropriate technique for a pair of device electrodes 2 and 3, which are then produced by photolithography (FIG. 1A).

Materials that can be used for the substrate 1 include quartz glass, glass containing impurities such as Na to a reduced concentration level, soda lime glass, glass substrate realized by forming an $SiO_2$ layer on soda lime glass by means of sputtering, ceramic substances such as alumina as well as Si.

While the oppositely arranged lower and higher potential side device electrodes 2 and 3 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, $RuO_2$, Pd—Ag, etc. and glass, transparent conducting materials such as $In_2O_3$—$SnO_2$ and semiconductor materials such as polysilicon.

Figure 1B:
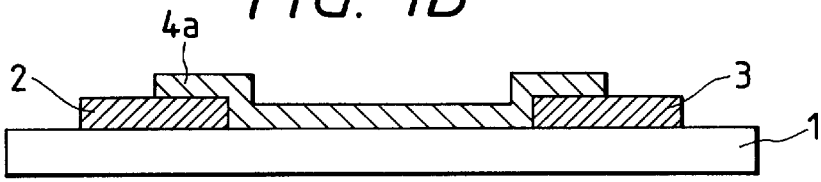

2) A film 4*a* of an organic metal compound or a complex thereof is formed on the substrate 1 that carries thereon the pair of device electrodes 2 and 3 (FIG. 1B).

While the film 4*a* is referred to as organic metal compound film hereinafter for the sake of simplification, it may alternatively be made of an inorganic metal complex as will be described hereinafter. For the purpose of the invention, an organic metal film 4*a* can be formed by applying a solution of an organic metal compound. The solution may contain an organic metal compound of the metal of the electroconductive film 4*b* as principal ingredient. Materials that can be used for the electroconductive film 4*b* include, but are not limited to, metals such as Pd, Pt, Ni, Ru, Ti, Zr, Hf, Cr, Fe, Ta, W, Nb, Ir and Mo, oxides such as PdO, $SnO_2$ and $In_2O_3$ and carbon. The organic metal film 4*a* is preferably made of an organic metal compound from which the electroconductive film 4*b* containing any of the above listed material as the principal ingredient can be produced by thermal decomposition. Materials that can be used for the organic metal film 4*a* include alkylated metals, salts of organic acids, alkoxides and organic metal complexes as well as some organic metal complexes including metal carbonyls and ammine complexes. The time stability of the organic metal film 4*a* may be improved and the patterning operation to be conducted thereon of the organic metal film 4*a* may become easy when the organic metal film 4*a* is pretreated by heat or irradiation of ultraviolet rays. For the purpose of the present invention, the pretreatment is desirably conducted under conditions that do not sufficiently decompose the organic metal film 4*a* to consequently turn it into an electroconductive film 4*b* as a result of the pretreatment.

For the purpose of the invention, the electric resistance of the organic metal film 4*a* is higher than that of the electroconductive film 4*b* produced through chemical decomposition of the organic metal film 4*a*. In actual terms, the electric resistance of the organic metal film 4*a* is desirably higher than that of the electroconductive film 4*b* by three digits, preferably more than three digits.

For the purpose of the invention, the organic metal film 4*a* may be patterned by lift-off, etching, laser trimming or printing such as ink-jet printing or offset printing.

3) Subsequently, the organic metal film 4*a* is thermally decomposed. For the purpose of the invention, a voltage is applied to the device electrodes 2 and 3 in this step by means of a voltage source (not shown).

Here, a process of baking the organic metal film 4*a* in a hot furnace in the atmosphere will be described.

Figure 1C:
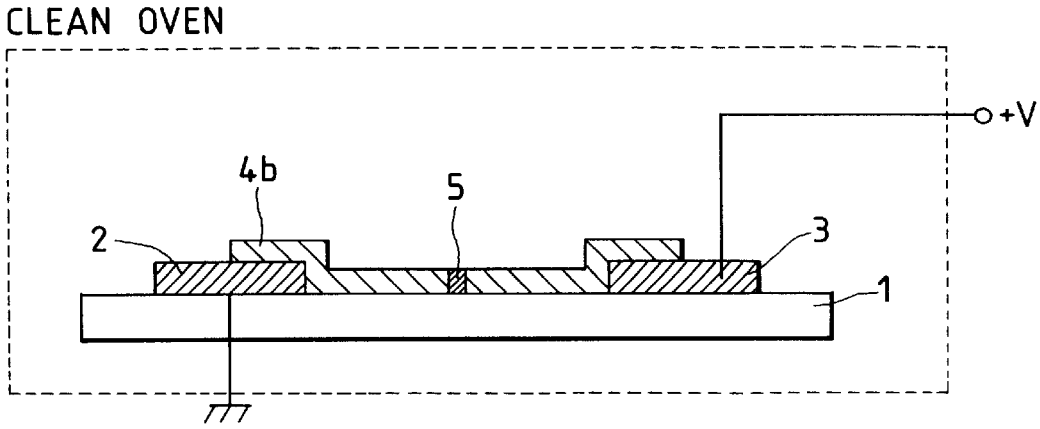

Initially, practically no electric current flows through the organic metal film 4*a* because it is electrically insulating. As the organic metal film 4*a* is heated to the decomposition temperature, the hydrocarbons contained therein are evaporated (or burnt) and metal atoms combine together to make the film electroconductive. The time period required for the organic metal film 4*a* to become an electroconductive film 4*b* is between several seconds and several hours depending on the rate of heating the film and the heating temperature, although it cannot normally become electroconductive instantaneously. In other words, the electric resistance of the film gradually falls during this period. From a microscopic viewpoint, it can be so presumed that the clusters of metal atoms existing in the film gradually grow to produce a network of electroconductive paths until the entire film becomes electroconductive. If an appropriate voltage is applied to the organic metal film 4*a* under this condition, an electric current flows at a high current density through the electroconductive paths that are being formed to generate Joule's heat, which heat then microscopically breaks and disrupts the current paths. Since this phenomenon occurs each time one or more than one electroconductive paths are formed, there appears a portion in the finally produced electroconductive film 4*b* that is locally and structurally destroyed, deformed or transformed. This portion makes an electron-emitting region 5 (FIG. 1C).

The profile of the electron-emitting region 5 produced in the electroconductive film 4*b* may differ depending on the conditions for heating and decomposing the organic metal film 4*a*, the level and the waveform of the voltage applied to the organic metal film 4*a* and other factors. Since the profile of the electron-emitting region 5 affects the electron-emitting performance of the electron-emitting device, all the electron-emitting regions 5 of the electron-emitting devices arranged in an electron source preferably have a substantially identical profile to make them operate uniformly for electric emission particularly when a large number of devices are arranged in the electron source.

Figure 2A:
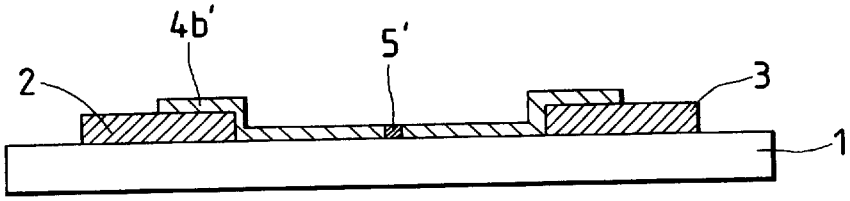
FIGS. 2A, 2B and 2C schematically illustrate different steps of manufacturing a surface conduction electron-emitting device in another preferred mode of carrying out the invention.
Figure 2B:
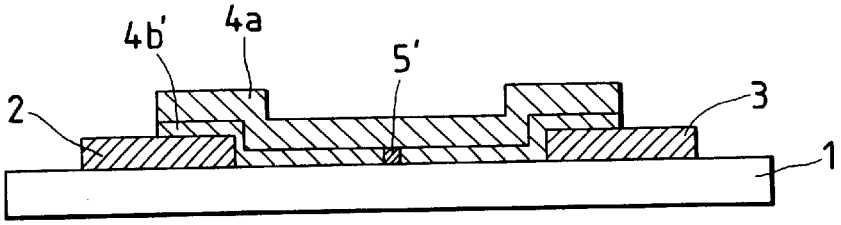
Figure 2C:
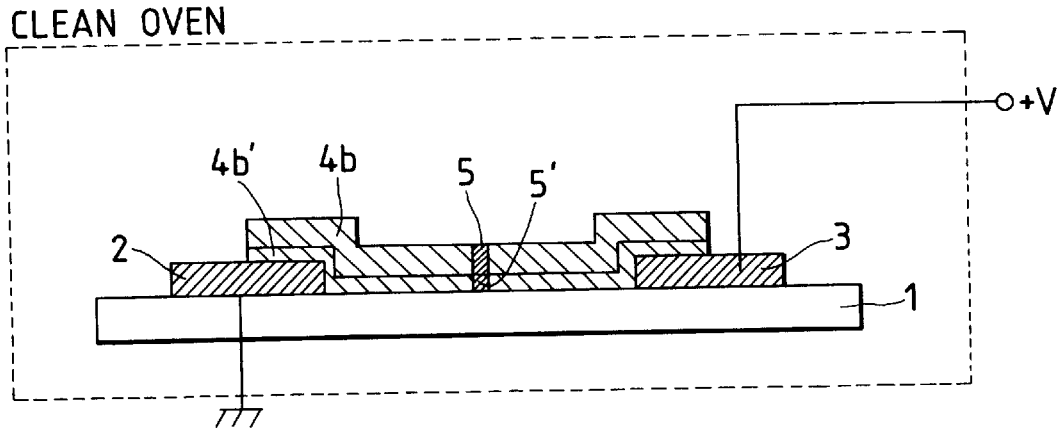

FIGS. 2A, 2B and 2C schematically illustrate a technique for producing electron-emitting devices having electron-emitting regions that have a substantially identical profile.

In FIGS. 2A, 2B and 2C, there are shown a substrate 1, a pair of device electrodes 2 and 3, an organic metal film 4*a*, a second electroconductive film produced by chemically decomposing the organic metal film 4*a*, a first electroconductive film 4*b*', an electron-emitting region 5 produced in the second electroconductive film and a fissure 5' produced in the first electroconductive film.

A thin film having a relatively low thermal resistivity is formed in advance as the first electroconductive film 4*b*' and then a fissure 5' is formed in it by a technique identical to the conventional energization forming as will be described hereinafter (FIG. 2A). The gaps 5' of the electron-emitting devices in an electron source according to the invention may be made to show a substantially identical profile if the first electroconductive film 4*b*' is formed to have a film thickness that allows the technique identical to the conventional energization forming process to be carried out at a low power consumption rate under appropriately selected conditions.

Then, an organic metal film 4*a* is formed thereon to produce a second electroconductive film 4*b* (FIG. 2B), which is subsequently and partly decomposed by heat, while applying a voltage, to produce an electron-emitting region 5 in the second electroconductive 4*b*. With this technique, since the electron-emitting region 5 is formed along the gap 5' of the first electroconductive film 4*b*', its profile can be so controlled that all the electron-emitting regions 5 of the electron-emitting devices arranged in an electron source show a substantially identical profile (FIG. 2C).

With any of the above described techniques, the organic metal film may be heated by means of a hot furnace or, alternatively, by means of an infrared lamp or laser beams if appropriate.

The technique of producing an electron-emitting region 5 in the electroconductive film 4*b* of an electron-emitting device by applying a voltage thereto and electrically energizing it is well known and referred to as energization forming. With this technique, the power required for the energization forming rises as the thickness of the film increases and therefore the electric resistance decreases. Likewise, the power consumption of the energization forming rises when a material having a high melting point is used. According to the invention, however, the energization forming proceeds gradually because the electroconductive film 4*b* is energized while it is heated and chemically decomposed. Therfore, the energization forming process can be carried out at a relatively low power consumption rate even if the thickness of the electroconductive film 4*b* to be finally obtained is large, and also a high melting point material may be used for the electroconductive film. Differently stated, according to the invention, since the energization forming process proceeds at scattered location and times, no instantaneous large power consumption rate occurs if a same amount of energy (power consumption rate×time) is consumed for the entire energization forming process notwithstanding that a thick or a high-melting-point material is used. Thus, for the purpose of the present invention, the thickness and the melting point of the electroconductive film 4*b* including the electron-emitting region 5 are not limited at least in terms of the power consumption rate of the energization forming process so that a relatively thick and thermally resistive (or high melting point) electroconductive film may be used.

The voltage to be applied for energization forming preferably has a pulse-shaped waveform. For the purpose of the invention, a constant voltage having a pulse-shaped waveform as illustrated in FIG. 3A is preferably used for energization forming.

Figure 3A:
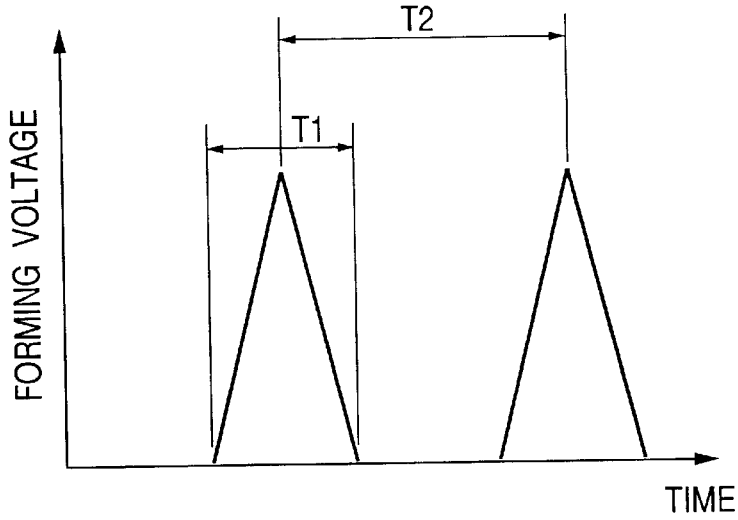
FIGS. 3A and 3B are graphs schematically illustrating the waveforms of two different voltage pulses that can be used for energization forming for the purpose of the invention.

Referring to FIG. 3A, T1 and T2 respectively denotes the pulse width and the pulse interval of the pulse-shaped voltage that are typically between 10 μsec and 10 μsec and between 10 μsec and hundreds of several msec. The wave height of the triangular voltage wave (the voltage of the energization forming process) may be selected appropriately as a function of the form of the surface conduction electron-emitting device. Anyhow, the voltage is applied for a time period between several seconds and tens of several minutes. Note that the waveform of the voltage is not limited to a triangle waveform, and the pulse voltage may alternatively have a rectangular waveform or some other waveform if desired.

The pulse voltage is applied until the organic metal film 4*a* is sufficiently decomposed to become an electroconductive film 4*b* and an electron-emitting region is formed therein.

For the purpose of the invention, the material and the thickness of the electroconductive film 4*b* can be selected in a manner as described below.

Figure 4:
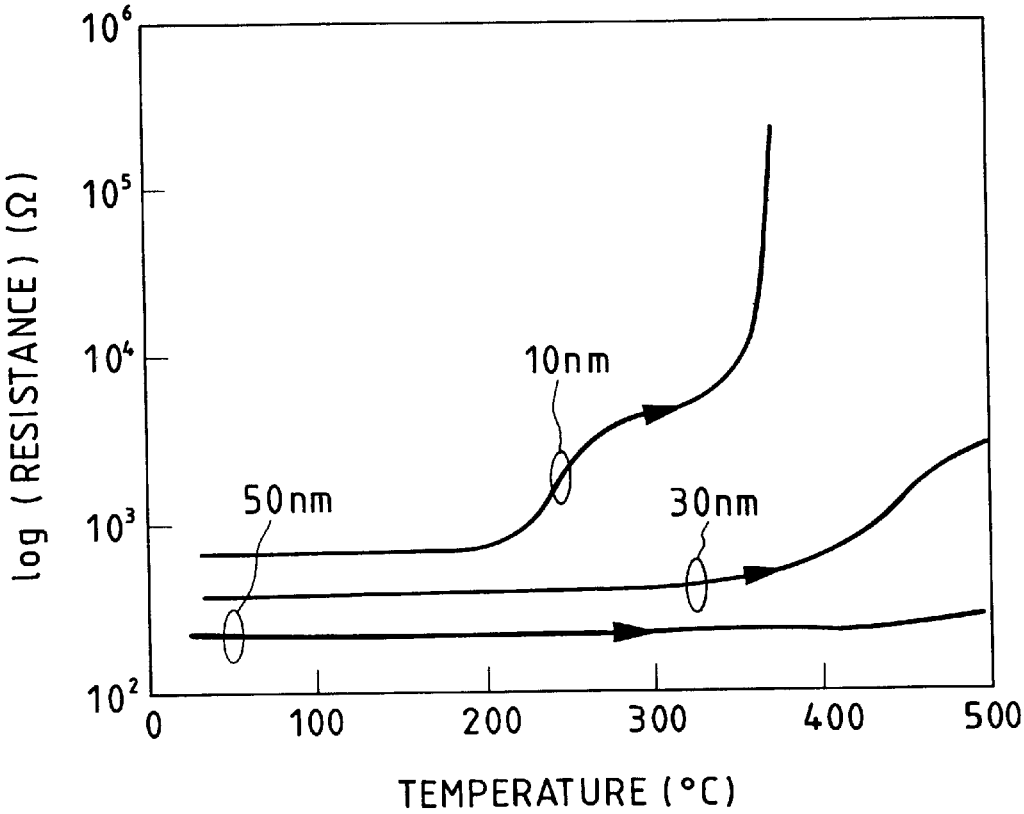
FIG. 4 is a graph schematically illustrating the performance of an electroconductive film that can be used for the purpose of the invention.

As described earlier, it is known that an ultrathin film or a fine particle film having a film thickness of about 10 nm is fused and aggregated at temperatures lower than the melting point of a bulk of the material of the electroconductive film. For example, while a bulk of metal palladium melts at 1552° C., a film of palladium fine particles having a film thickness of 10 nm can be fused and aggregated when heated to about 250° C. depending on the type of the substrate and that of the heated atmosphere. When fused and aggregated, the film produces a discontinuous state to remarkably deteriorate the electric conductivity of the film. FIG. 4 shows a graph schematically illustrating the relationship between the temperature and the electric resistance of a metal palladium film with various different film thicknesses produced by thermal decomposition of an organic palladium compound laid on a quartz substrate. As seen the electric resistance rises abruptly as the film is fused and aggregated. Note that the change that occurs in the electric resistance is irreversible and, therefore, the raised electric resistance does not fall back if the temperature falls. Thus, such a film cannot be used for an electroconductive film for the purpose of the invention.

The dependency of the fusion and aggregation temperature on the film thickness is observed in various materials. However, it will be understood that, if a bulk of a material has a high melting point, a thin film of the material will accordingly show a high fusion and aggregation temperature. For instance, a bulk of metal tungsten has a melting point of 3,380° C. and an ultrathin film of tungsten having a film thickness of about 10 nm would not be fused nor aggregated if heated to about 600° C.

A principal objective of the present invention is to provide the electroconductive film 4*b* with thermal resistivity to make the film withstand the heat that can appear in the process of manufacturing the electron-emitting device and at the time driving the device. Since the electroconductive film 4*b* is exposed to temperatures between 400° C. to 500° C. in the process of manufacturing the electron-emitting device as described above, it preferably has a thermal resistivity for temperatures up to 500° C., although no problem arises if the electroconductive film can withstand higher temperatures.

Thus, for the purposes of the present invention, the material and the thickness of the electroconductive film 4*b* should be so selected that its electric resistance is not irreversibly changed at temperatures lower than 500° C.

4) After the process of decomposing the electroconductive film 4*b* and that of energization forming, the device is preferably subjected to an activation process. An activation process is a process to be carried out in order to dramatically change the device current If and the emission current Ie.

Figure 1D:
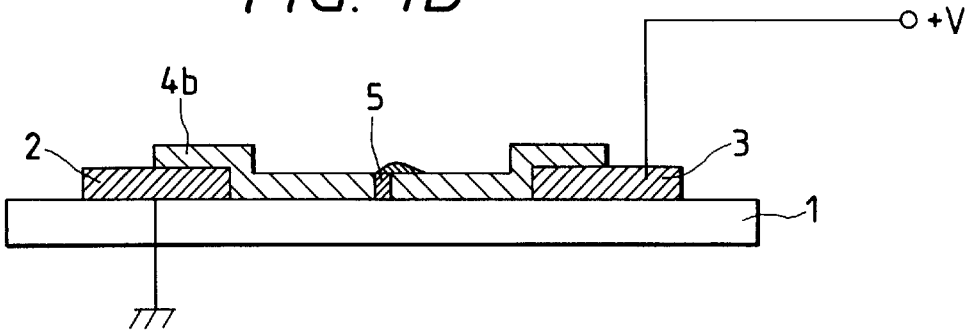

In an activation process, a pulse voltage may be repeatedly applied as in the case of energization forming in an organic gas containing atmosphere. Such an atmosphere may be produced by utilizing the organic gas remaining in a vacuum chamber after evacuating the chamber by means of an oil diffusion pump or a rotary pump or by sufficiently evacuating a vacuum chamber by means of an ion pump and thereafter introducing the gas of an organic substance into the vacuum. The suitable gas pressure of the organic substance is determined as a function of the profile of the electron-emitting device to be treated, the profile of the vacuum chamber, the type of the organic substance and other factors. Organic substances that can be suitably used for the purpose of the activation process include aliphatic hydrocarbons such as alkanes, alkenes and alkynes, aromatic hydrocarbons, alcohols, aldehydes, ketones, amines, organic acids such as, phenol, carbonic acids and sulfonic acids. Specific examples include saturated hydrocarbons expressed by general formula $C_nH_{2n+2}$ such as methane, ethane and propane, unsaturated hydrocarbons expressed by general formula $C_nH_{2n}$ such as ethylene and propylene, benzene, toluene, methanol, ethanol, formaldehyde, acetaldehyde, acetone, methyl ethyl ketone, methylamine, ethylamine, phenol, formic acid, acetic acid and propionic acid. As a result of this process, carbon and/or carbon compounds arising from the organic substances contained in the atmosphere are deposited on the device to remarkably change the device current If and the emission current Ic (FIG. 1D). Note that FIG. 1D only schematically illustrates the carbon and/or carbon compounds deposited on the device and does not show the fine structure of the deposit.

The activation process is terminated whenever appropriate, observing the device current If and/or the emission current Ie. The pulse width, the pulse interval and the pulse wave height are appropriately selected.

For the purpose of the invention, carbon and carbon compounds typically refer to graphite (including so-called high oriented pyrolitic graphite (HOPG), pyrolitic graphite (PG) and glassy carbon (GC)), and non-crystalline carbon. HOPG has a nearly perfect crystal structure of graphite, PG contains crystal grains having a size of about 20 nm with a somewhat disturbed crystal structure, while GC contains crystal grains having a size as small as 2 nm with a crystal structure that is remarkably in disarray. Non-crystalline carbon includes amorphous carbon and a mixture of amorphous carbon and fine crystals of graphite. The thickness of film formed by deposition is preferably less than 50 nm and more preferably less than 30 nm.

While the activation process is conducted in the above described manner, the step 3 of decomposing the organic metal film 4*a* and the activation step 4 may be conducted simultaneously for the purpose of the present invention in a manner as described below.

Firstly, an organic metal film 4*a* is formed by means of the technique described in Step 2 above. Then, the organic metal film 4*a* is decomposed as it is heated in vacuum, while applying a voltage thereto. As the organic metal film 4*a* gets to the temperature at which the material of the organic metal compound is thermally decomposed, the metal atoms released from the compound begin to combine together. The hydrocarbon components of the compound that are not burnt by heat partly evaporate into the vacuum and partly remain in the film. If an appropriate voltage, or an activation voltage (=energization forming voltage), is applied to the organic metal film 4*a* during this process, there appears a portion in the electroconductive film 4*b* produced as a result of decomposition that has been locally destroyed, deformed or transformed. Under this condition, some of the hydrocarbon components of the electroconductive film 4*b* are diffused within the film or discharged into the gas phase and readhere to the film to produce a deposit of carbon and/or carbon compounds on the device and remarkably increase both the device current If and the emission current Ie. In other words, an activation process takes place.

The above operation can be conducted in an atmosphere of inert gas such as nitrogen or helium.

The time required for the activation process can be reduced by introducing in advance an appropriate gaseous organic substance into the reaction system as described in Step 4 above.

5) An electron-emitting device according to the invention that has passed through the above steps is preferably subjected to a stabilizing step. This step is designed to evacuate the vacuum container arranged for manufacturing the device in order to eliminate organic substances therefrom so that no subsequent deposit may be produced on the device and the device may operate properly. For carrying out the stabilization process, the pressure in the vacuum container is held to be preferably less than $1.3\times10^{-5}$ Pa and more preferably less than $1.3\times10^{-6}$ Pa. For evacuating the vacuum container, it is preferable that the entire container is heated so that the molecules of the organic substances adsorbed to the inner walls of the container and the electron-emitting device may easily move away therefrom and become removed from the container. The heating operation is preferably conducted at as high a temperature as possible for a period of time as long as possible provided that the thermal stability of the components of the vacuum container and those of the electron-emitting device are maintained. The heating conditions should be appropriately determined by taking these factors into consideration. Note that a method of manufacturing an electron-emitting device according to the invention is advantageous for using higher temperature because the thermal resistance of the electroconductive film is remarkably improved.

If the step of forming the electron-emitting region and the activation step are conducted simultaneously in vacuum, this stabilizing step can be carried out easily because no organic substances have to be introduced into the vacuum container.

After completing the stabilizing step, the electron-emitting device is preferably driven in an atmosphere identical to that in which said stabilizing process is terminated, although a different atmosphere may also be used. So long as the organic substances are satisfactorily removed, a lower degree of vacuum may be permissible for a stabilized operation of the device.

With the use of such a vacuum condition, any additional deposition of carbon and/or carbon compounds is effectively prevented to stabilize both the device current If and the emission current Ie.

The performance of an electron-emitting device prepared by way of the above processes, to which the present invention is applicable, will be described by referring to FIGS. 5 and 6.

Figure 5:
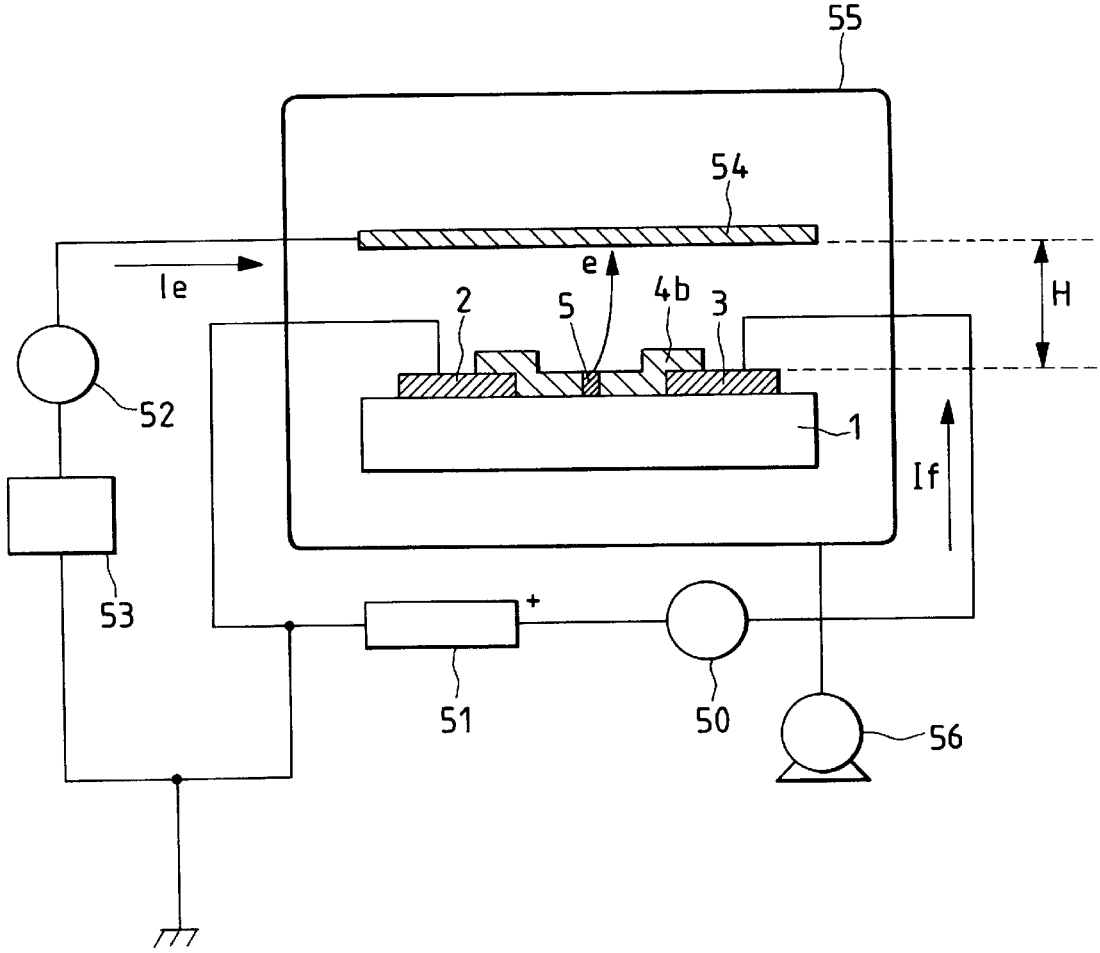
FIG. 5 is a schematic illustration of a gauging system to be used to evaluate the performance of an electron-emitting device according to the invention.

FIG. 5 is a schematic block diagram of an arrangement comprising a vacuum chamber that can be used for the above processes. It can also be used as a gauging system for determining the performance of an electron emitting device of the type under consideration. In FIG. 5, the components identical to or similar to those of FIGS. 1A to 1D are denoted respectively by the same reference symbols. Referring to FIG. 5, the gauging system includes a vacuum chamber 55 and a vacuum pump 56. An electron-emitting device is placed in the vacuum chamber 55. The device comprises a substrate 1, a pair of device electrodes 2 and 3, an electroconductive film 4*b* and an electron-emitting region 5. Otherwise, the gauging system has a power source 51 for applying a device voltage Vf to the device, an ammeter 50 for metering the device current If running through the electroconductive film 4*b* between the device electrodes 2 and 3, an anode 54 for capturing the emission current Ie produced by electrons emitted from the electron-emitting region of the device, a high voltage source 53 for applying a voltage to the anode 54 of the gauging system and another ammeter 52 for metering the emission current Ie produced by electrons emitted from the electron-emitting region 5 of the device. For determining the performance of the electron-emitting device, a voltage between 1 and 10 KV may be applied to the anode, which is spaced apart from the electron emitting device by distance H which is between 2 and 8 mm.

Instruments including a vacuum gauge (not shown) necessary for the gauging system are arranged in the vacuum chamber 55 so that the performance of the electron-emitting device in the chamber may be properly tested in vacuum. The vacuum pump 56 is provided with an ordinary high vacuum system comprising a turbo pump or a rotary pump or an oil-free high vacuum system comprising an oil-free pump such as a magnetic levitation turbo pump or a dry pump and an ultra-high vacuum system comprising an ion pump. The vacuum chamber containing an electron source therein can be heated by means of a heater (not shown). Thus, all the processes from the energization forming process on can be carried out with this arrangement.

Figure 6:
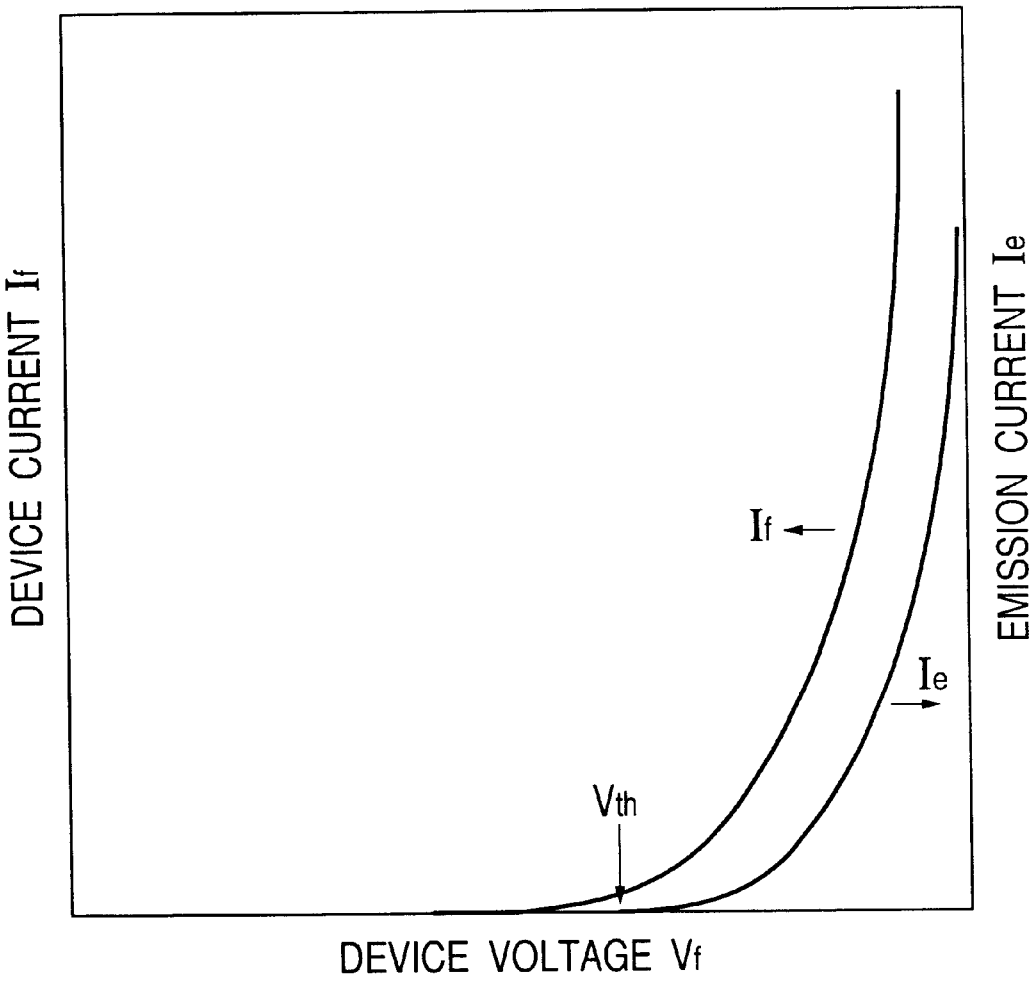
FIG. 6 is a graph schematically illustrating the relationship between the device voltage Vf and the device current If and with the relationship between the device voltage Vf and the emission current Ie of an electron-emitting device according to the invention.

FIG. 6 shows a graph schematically illustrating the relationship between the device voltage Vf and the emission current Ie and the device current If typically observed by the gauging system of FIG. 5. Note that different units are arbitrarily selected for Ie and If in FIG. 6 in view of the fact that Ie has a magnitude far smaller than that of If. Note that both the vertical and transversal axes of the graph represent a linear scale.

As seen in FIG. 6, an electron-emitting device according to the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter), whereas the emission current Ie is practically undetectable when the applied voltage is found lower than the threshold value Vth. Differently stated, an electron-emitting device according to the invention is a non-linear device having a clear threshold voltage Vth to the emission current Ie.

(ii) Secondly, since the emission current Ie is highly dependent on the device voltage Vf and increases monotonically, the former can be effectively controlled by way of the latter.

(iii) Thirdly, the emitted electric charge captured by the anode 54 is a function of the duration of time of application of the device voltage Vf. In other words, the amount of electric charge captured by the anode 54 can be effectively controlled by way of the time during which the device voltage Vf is applied.

Because of the above remarkable features, it will be understood that the electron-emitting performance of an electron-emitting device according to the invention can easily be controlled in response to the input signal. Thus, an electron source comprising a large number of such electron-emitting devices and an image-forming apparatus may find a variety of applications.

On the other hand, the device current If either monotonically increases relative to the device voltage Vf (as shown by a solid line in FIG. 6, a characteristic referred to as "MI characteristic" hereinafter) or changes to show a curve (not shown) specific to a voltage-controlled-negative-resistance characteristic (a characteristic referred to as "VCNR characteristic" hereinafter). These characteristics of the device current are dependent on a number of factors including the manufacturing method, the conditions where it is gauged and the environment for operating the device.

Figure 7A:
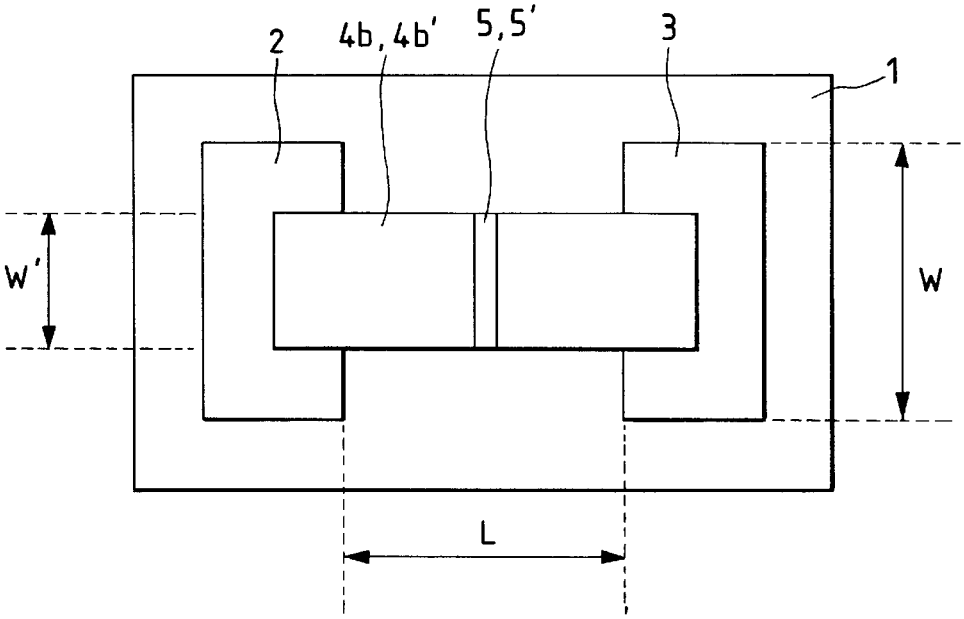
FIGS. 7A and 7B are schematic plan and sectional views of a surface conduction electron-emitting device according to the invention and having a basic plane type configuration.
Figure 7B:
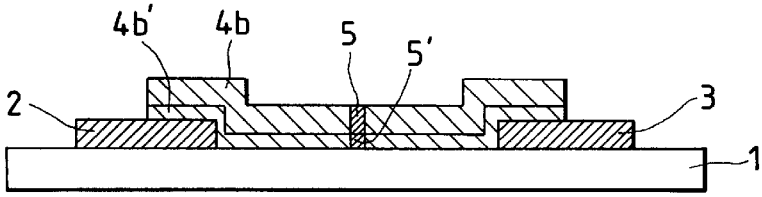
Figure 8:
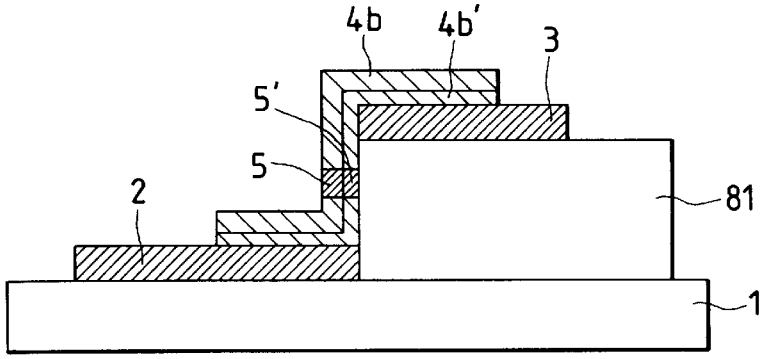
FIG. 8 is a schematic sectional view of a surface conduction electron-emitting device according to the invention and having a basic step type configuration.

A surface conduction electron-emitting device according to the invention may be either of a plane type as shown in FIGS. 7A and 7B (having a configuration as described above by referring to FIGS. 1A, 1B, 1C, 1D, 2A, 2B and 2C) or of a step type having a configuration as illustrated in FIG. 8. Now, the difference between the two types will be described in terms of the electroconductive film having a laminate structure as shown in FIGS. 2A, 2B and 2C.

Note that the components of the plane type surface conduction electron-emitting device illustrated in FIGS. 7A and 7B that are the same as those of FIGS. 2A, 2B and 2C are denoted by the same reference symbols. The distance L separating the device electrodes 2 and 3, the length of the device electrodes 2 and 3, the profile of the second electroconductive film 4*b* and that of the first electroconductive film 4*b*' are determined to make the device advantageously adapted to its application.

The components of the step type surface conduction electron-emitting device illustrated in FIG. 8 that are the same as those of FIGS. 2A, 2B and 2C are also denoted by the same reference symbols. In FIG. 8, reference numeral 81 denotes a step-forming section. The substrate 1, the device electrodes 2 and 3, the second electroconductive film 4*b*, and the first electroconductive film 4*b*', the electron-emitting region 5 and the fissure 5' may be made of respective materials that are same as those of the corresponding components of the flat type surface conduction electron-emitting device described above. The step-forming section 81 may be made of an insulating material such as $SiO_2$ that is produced by means of an appropriate technique such as vacuum evaporation, printing or sputtering. The thickness of the step-forming section 81 of a step type surface conduction electron-emitting device corresponds to the distance L separating the device electrodes of a plane type surface conduction electron-emitting device.

The first electroconductive film 4*b*' is formed on the device electrodes 2 and 3 after preparing the device electrodes 2 and 3 and the step-forming section 81. After producing the fissure 5 ' in the first electroconductive film 4*b*' by a technique identical to the conventional energization forming process, the second electroconductive film 4*b* is formed on the first electroconductive film 4*b*'. While the fissure 5' and the electron-emitting region 5 are formed in the step-forming section 81 in FIG. 8, their profiles and the locations are not limited thereto and may vary depending on the manufacturing conditions and particularly the energization forming conditions (of the first electroconductive film in particular).

Now, some examples of the usage of electron-emitting devices, to which the present invention is applicable, will be described. An electron source and hence an image-forming apparatus can be realized by arranging a plurality of electron-emitting devices according to the invention on a substrate.

Electron-emitting devices may be arranged on a substrate in a number of different modes.

For instance, a number of electron-emitting devices may be arranged in parallel rows along a direction (hereinafter referred to row-direction), each device being connected by wires at opposite ends thereof, and driven to operate by control electrodes (hereinafter referred to as grids) arranged in a direction perpendicular to the row direction (hereinafter referred to as column-direction) to realize a ladder-like arrangement. Alternatively, a plurality of electron-emitting devices may be arranged in rows along an X-direction and columns along an Y-direction to form a matrix, the X- and Y-directions being perpendicular to each other, and the electron-emitting devices on a same row are connected to a common X-directional wire by way of one of the electrodes of each device while the electron-emitting devices on a same column are connected to a common Y-directional wire by way of the other electrode of each device. The latter arrangement is referred to as a simple matrix arrangement. Now, the simple matrix arrangement will be described in detail.

In view of the above described three basic characteristic features (i) through (iii) of a surface conduction electron-emitting device, to which the invention is applicable, it can be controlled for electron emission by controlling the wave height and the wave width of the pulse voltage applied to the opposite electrodes of the device above the threshold voltage level. On the other hand, the device does not practically emit any electron below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices.

Figure 9:
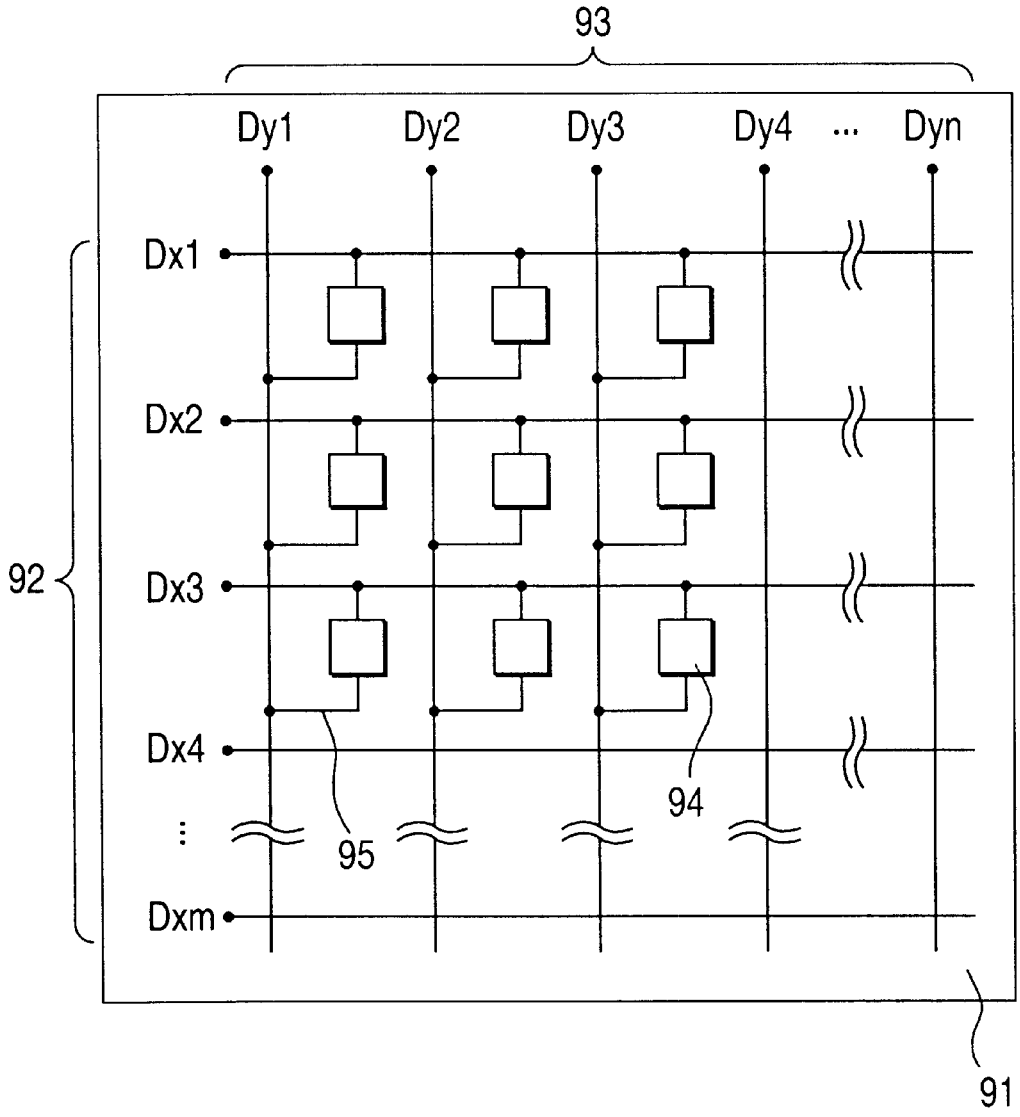
FIG. 9 is a schematic illustration of an electron source having a simple matrix wiring arrangement.

FIG. 9 is a schematic plan view of the substrate of an electron source realized by arranging a plurality of electron-emitting devices, to which the present invention is applicable, in order to exploit the above characteristic features. In FIG. 9, the electron source comprises a substrate 91, X-directional wires 92, Y-directional wires 93, surface conduction electron-emitting devices 94 and connecting wires 95. The surface conduction electron-emitting devices may be either of the flat type or of the step type described earlier.

There are provided a total of m X-directional wires 92, which are donated by Dx1, Dx2, . . . , Dxm and made of an electroconductive metal produced by vacuum deposition, printing or sputtering. The material, the thickness and the width of the wires may be selected appropriately. A total of n Y-directional wires are arranged and donated by Dy1, Dy2, . . . , Dyn, which are similar to the X-directional wires in terms of material, thickness and width. An interlayer insulation layer (not shown) is disposed between the m X-directional wires and the n Y-directional wires to electrically isolate them from each other. (Both m and n are integers.)

The interlayer insulation layer (not shown) is typically made of $SiO_2$ and formed on the entire surface or part of the surface of the insulating substrate 91 to show a desired contour by means of vacuum deposition, printing or sputtering. The thickness, material and manufacturing method of the interlayer insulation layer are so selected as to make it withstand the potential difference between any of the X-directional wires 92 and any of the Y-directional wires 93 observable at the crossing thereof. Each of the X-directional wires 92 and the Y-directional wires 93 is drawn out to form an external terminal.

The oppositely arranged electrodes (not shown) of each of the surface conduction electron-emitting devices 94 are connected to a related one of the m X-directional wires 92 and a related one of the n Y-directional wires 93 by respective connecting wires 95 which are made of an electroconductive metal.

The electroconductive metal material of the device electrodes and that of the connecting wires 95 extending from the m X-directional wires 92 and the n Y-directional wires 93 may be same or contain a common element as an ingredient. Alternatively, they may be different from each other. These materials may be appropriately selected typically from the candidate materials listed above for the device electrodes. If the device electrodes and the connecting wires are made of the same material, they may be collectively called device electrodes without discriminating the connecting wires.

The X-directional wires 92 are electrically connected to a scan signal application means (not shown) for applying a scan signal to a selected row of surface conduction electron-emitting devices 94. On the other hand, the Y-directional wires 93 are electrically connected to a modulation signal generation means (not shown) for applying a modulation signal to a selected column of surface conduction electron-emitting devices 94 and modulating the selected column according to an input signal. Note that the drive signal to be applied to each surface conduction electron-emitting device is expressed as the voltage difference of the scan signal and the modulation signal applied to the device.

With the above arrangement, each of the devices can be selected and driven to operate independently by means of a simple matrix wiring arrangement.

Figure 10:
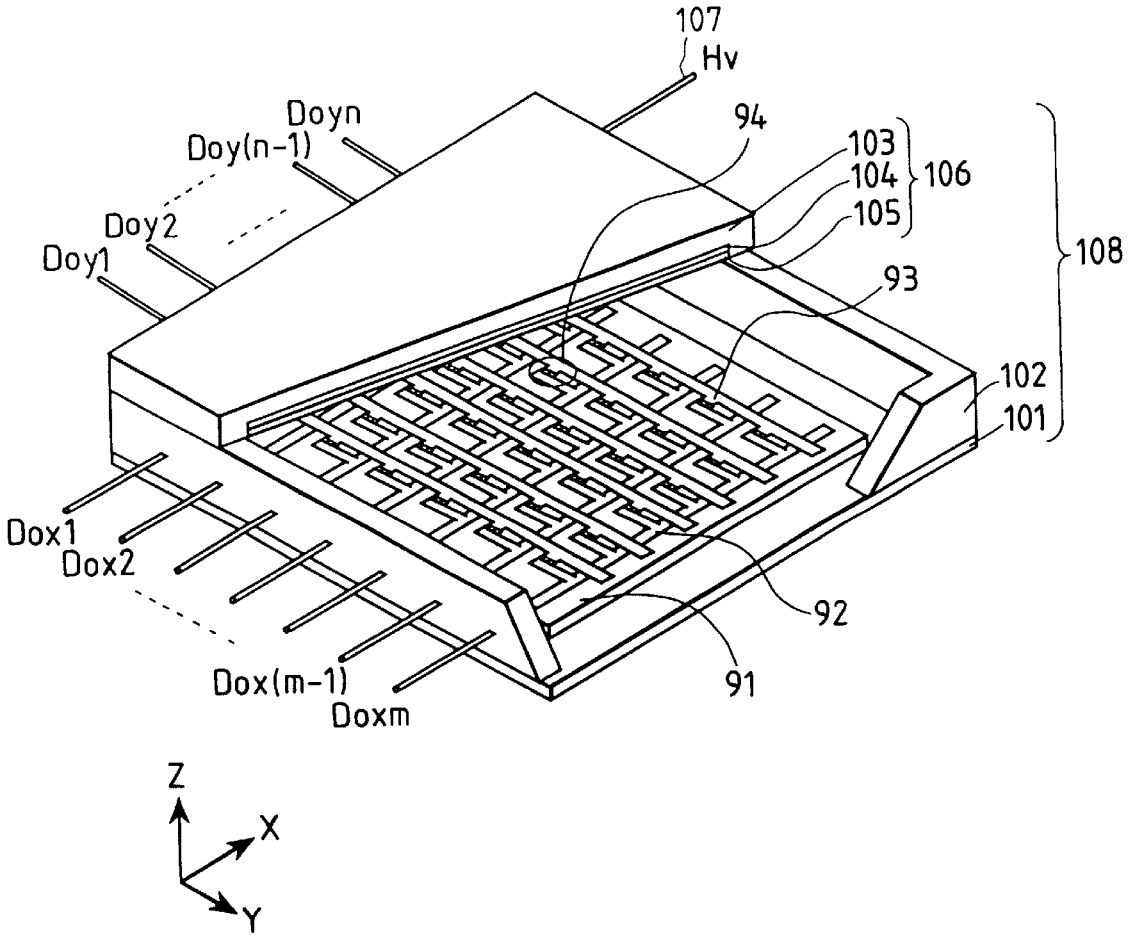
FIG. 10 is a partly cut away schematic perspective view of a display panel that can be used for an image-forming apparatus according to the invention.
Figure 11A:
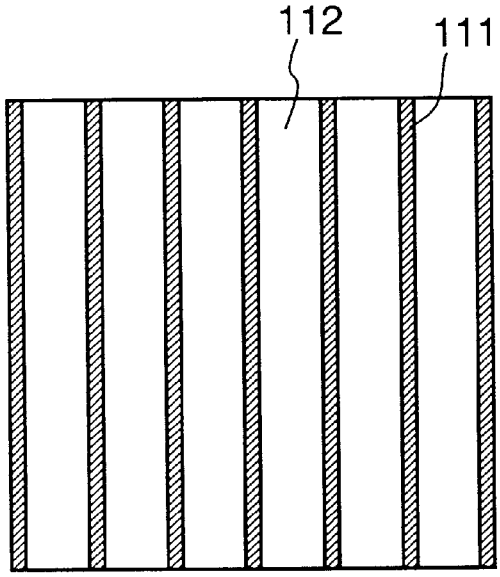
FIGS. 11A and 11B are two possible designs of fluorescent film that can be used for a display panel for the purpose of the invention.
Figure 11B:
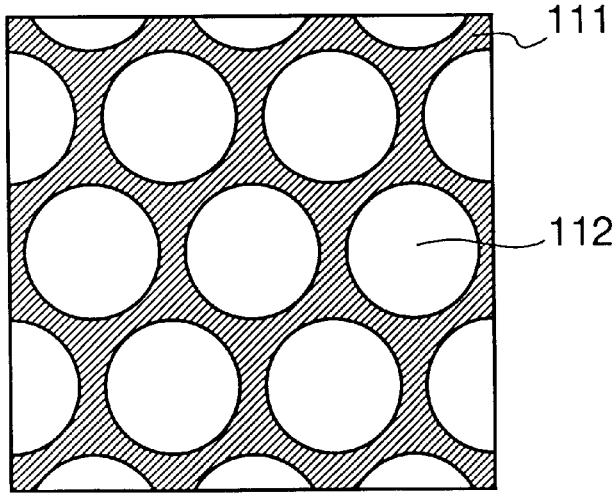
Figure 12:
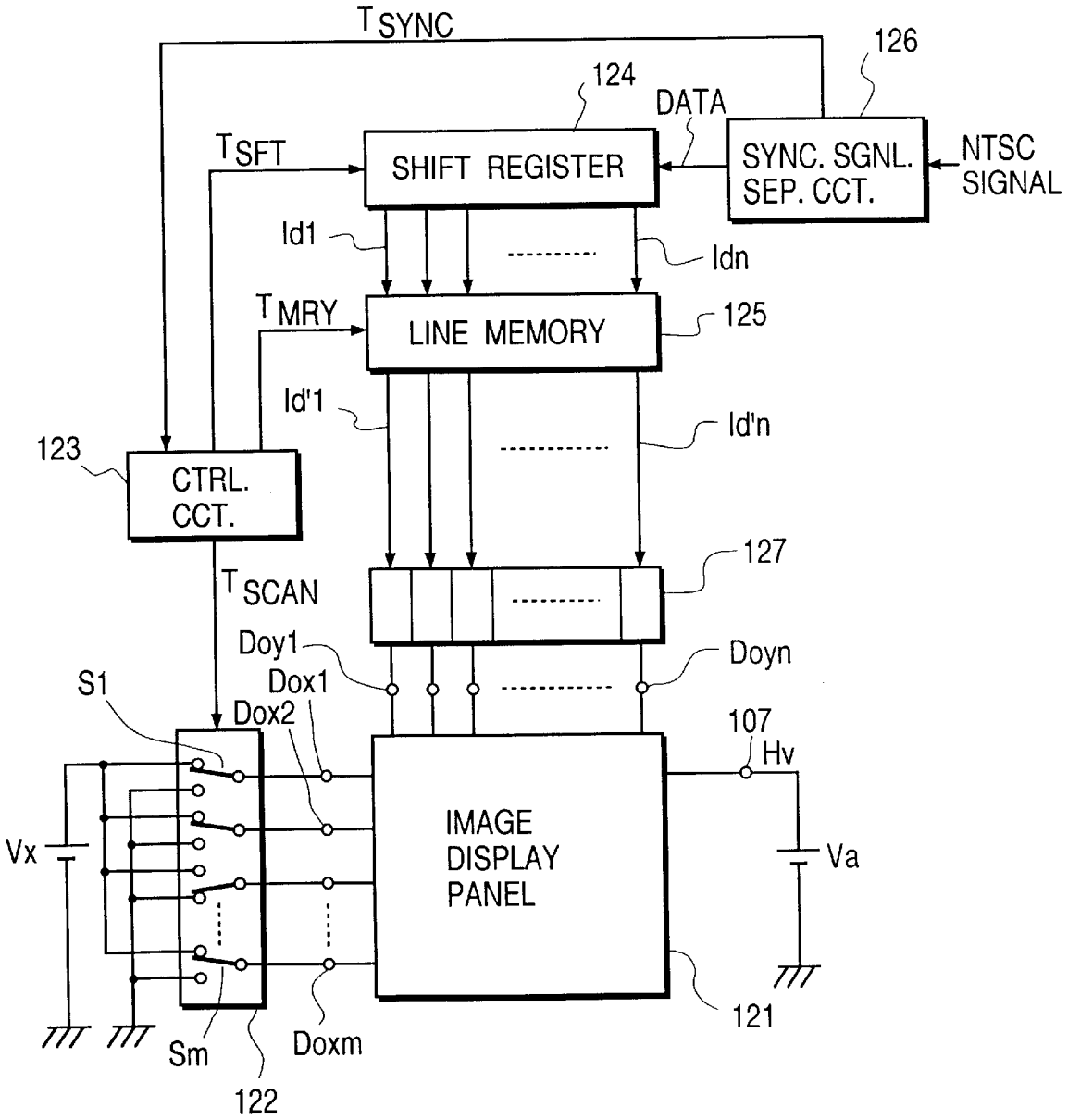
FIG. 12 is a schematic block diagram of a drive circuit that can be used to drive an image-forming apparatus adapted to display images according to NTSC signals.

Now, an image-forming apparatus comprising an electron source having a simple matrix arrangement as described above will be described by referring to FIGS. 10, 11A, 11B and 12. FIG. 10 is a partially cut away schematic perspective view of the image forming apparatus and FIGS. 11A and 11B are schematic views, illustrating two possible configurations of a fluorescent film that can be used for the image forming apparatus of FIG. 10, whereas FIG. 12 is a block diagram of a drive circuit for the image forming apparatus of FIG. 10 that operates for NTSC television signals.

Referring firstly to FIG. 10 illustrating the basic configuration of the display panel of the image-forming apparatus, it comprises an electron source substrate 91 of the above described type carrying thereon a plurality of electron-emitting devices, a rear plate 101 rigidly holding the electron source substrate 91, a face plate 106 prepared by laying a fluorescent film 104 and a metal back 105 on the inner surface of a glass substrate 103 and a support frame 102, to which the rear plate 101 and the face plate 106 are bonded by means of frit glass. Reference numeral 109 denotes an envelope, which is baked to 400 to 500° C. for more than 10 minutes in the atmosphere or in nitrogen and hermetically and airtightly sealed.

In FIG. 10, reference numeral 94 denotes a region corresponding to the electron-emitting region of each electron-emitting device as illustrated in FIGS. 7A and 7B and reference numerals 99 and 93 respectively denote the X-directional wire and the Y-directional wire connected to the respective device electrodes of each electron-emitting device.

While the envelope 108 is normally constituted by the face plate 106, the support frame 102 and the rear plate 101 in the above described embodiment, the rear plate 101 may be omitted if the substrate 91 is strong enough by itself because the rear plate 101 is provided mainly for reinforcing the substrate 91. If such is the case, an independent rear plate 101 may not be required and the substrate 91 may be directly bonded to the support frame 102 so that the envelope 108 is constituted by a face plate 106, a support frame 102 and a substrate 91. The overall strength of the envelope 108 against the atmospheric pressure may be increased by arranging a number of support members called spacers (not shown) between the face plate 106 and the rear plate 101.

FIGS. 11A and 11B schematically illustrate two possible arrangements of fluorescent film. While the fluorescent film 104 comprises only a single fluorescent body if the display panel is used for showing black and white pictures, to display color pictures it needs to comprise black conductive members 111 and fluorescent bodies 112, of which the former are referred to as black stripes or members of a black matrix depending on the arrangement of the fluorescent bodies. Black stripes or members of a black matrix are arranged for a color display panel so that the fluorescent bodies 112 of three different primary colors are made less distinct and the adverse effect of reducing the contrast of displayed images external light is weakened by blackening the surrounding areas. While graphite is normally used as a principal ingredient of the black stripes, other conductive material having low light transmissivity and reflectivity may alternatively be used.

A precipitation or printing technique may be used for applying a fluorescent material on the glass substrate whether it is for a black and white or color display. An ordinary metal back 105 is arranged on the inner surface of the fluorescent film 104. The metal back 105 is provided in order to enhance the luminance of the display panel by causing the rays of light emitted from the fluorescent bodies and directed to the inside of the envelope to turn back toward the face plate 106, to use it as an electrode for applying an accelerating voltage to electron beams and to protect the fluorescent bodies against damage that may be caused when negative ions generated inside the envelope collide with them. It is prepared by smoothing the inner surface of the fluorescent film (in an operation normally called "filming") and forming an Al film thereon by vacuum deposition after forming the fluorescent film.

A transparent electrode (not shown) may be formed on the face plate 106 facing the outer surface of the fluorescent film 104 in order to raise the conductivity of the fluorescent film 104.

Care should be taken to accurately align each set of color fluorescent bodies and an electron-emitting device, if a color display is involved, before the above listed components of the envelope are bonded together.

An image forming apparatus as illustrated in FIG. 10 may be manufactured in a below described manner.

The envelope 108 is evacuated by means of an appropriate vacuum pump such as an ion pump or a sorption pump that does not involve the use of oil, while it is being heated as in the case of the stabilization process, until the atmosphere in the inside is reduced to a degree of vacuum of $1.3\times10^{-5}$ Pa containing organic substances to a sufficiently low level and then it is hermetically and airtightly sealed. A getter process may be conducted in order to maintain the achieved degree of vacuum in the inside of the envelope 108 after it is sealed. In a getter process, a getter arranged at a predetermined position (not shown) in the envelope 108 is heated by means of a resistance heater or a high frequency heater to form a film by vapor deposition immediately before or after the envelope 108 is sealed. A getter typically contains Ba as a principal ingredient and can maintain a degree of vacuum between $1.3\times10^{-3}$ and $1.3\times10^{-5}$ Pa by the adsorption effect of the vapor deposition film. The processes of manufacturing surface conduction electron-emitting devices of the image forming apparatus after the forming process may appropriately be designed to meet the specific requirements of the intended application.

Now, a drive circuit for driving a display panel comprising an electron source with a simple matrix arrangement for displaying television images according to NTSC television signals will be described by referring to FIG. 12. In FIG. 12, reference numeral 121 denotes a display panel. Otherwise, the circuit comprises a scan circuit 122, a control circuit 123, a shift register 124, a line memory 125, a synchronizing signal separation circuit 126 and a modulation signal generator 127. Vx and Va in FIG. 12 denote DC voltage sources.

The display panel 121 is connected to external circuits via terminals Dox1 through Doxm, doy1 through Doyn and high voltage terminal Hv, of which terminals Dox1 through Doxm are designed to receive scan signals for sequentially driving on a one-by-one basis the rows (of N devices) of an electron source in the apparatus comprising a number of surface-conduction type electron-emitting devices arranged in the form of a matrix having M rows and N columns.

On the other hand, terminals doy1 through Doyn are designed to receive a modulation signal for controlling the output electron beam of each of the surface-conduction type electron-emitting devices of a row selected by a scan signal. High voltage terminal 107 is fed by the DC voltage source Va with a DC voltage of a level typically around 10 kV, which is sufficiently high to energize the fluorescent bodies of the selected surface-conduction type electron-emitting devices.

The scan circuit 122 operates in a manner as follows. The circuit comprises M switching devices (of which only devices S1 and Sm are specifically indicated in FIG. 12), each of which takes either the output voltage of the DC voltage source Vx or 0[V] (the ground potential level) and comes to be connected with one of the terminals Dox1 through Doxm of the display panel 121. Each of the switching devices S1 through Sm operates in accordance with control signal Tscan fed from the control circuit 123 and can be prepared by combining transistors such as FETs.

The DC voltage source Vx of this circuit is designed to output a constant voltage such that any drive voltage applied to devices that are not being scanned due to the performance of the surface conduction electron-emitting devices (or the threshold voltage for electron emission) is reduced to less than threshold voltage.

The control circuit 123 coordinates the operations of related components so that images may be appropriately displayed in accordance with externally fed video signals. It generates control signals Tscan, Tsft and Tmry in response to synchronizing signal Tsync fed from the synchronizing signal separation circuit 126, which will be described below.

The synchronizing signal separation circuit 126 separates the synchronizing signal component and the luminance signal component form an externally fed NTSC television signal and can be easily realized using a popularly known frequency separation (filter) circuit. Although a synchronizing signal extracted from a television signal by the synchronizing signal separation circuit 126 is constituted, as is well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 124, is designated as DATA signal.

The shift register 124 carries out for each line a serial/parallel conversion on DATA signals that are serially fed on a time series basis in accordance with control signal Tsft fed from the control circuit 123. (In other words, a control signal Tsft operates as a shift clock for the shift register 124.) A set of data for a line that have undergone a serial/parallel conversion (and correspond to a set of drive data for N electron-emitting devices) are sent out of the shift register 124 as N parallel signals Id1 through Idn.

The line memory 125 is a memory for storing a set of data for a line, which are signals Id1 through Idn, for a required period of time according to control signal Tmry coming from the control circuit 123. The stored data are sent out as I'd1 through I'dn and fed to modulation signal generator 127.

Said modulation signal generator 127 is in fact a signal source that appropriately drives and modulates the operation of each of the surface-conduction type electron-emitting devices and output signals of this device are fed to the surface-conduction type electron-emitting devices in the display panel 121 via terminals doy1 through Doyn.

As described above, an electron-emitting device, to which the present invention is applicable, is characterized by the following features in terms of emission current Ie. Firstly, there exists a clear threshold voltage Vth and the device emits electrons only when a voltage exceeding Vth is applied thereto. Secondly, the level of emission current Ie changes as a function of the change in the applied voltage above the threshold level Vth, although the value of Vth and the relationship between the applied voltage and the emission current may vary depending on the materials, the configuration and the manufacturing method of the electron-emitting device. More specifically, when a pulse-shaped voltage is applied to an electron-emitting device according to the invention, practically no emission current is generated as long as the applied voltage remains under the threshold level, whereas an electron beam is emitted once the applied voltage rises above the threshold level. It should be noted here that the intensity of an output electron beam can be controlled by changing the peak level Vm of the pulse-shaped voltage. Additionally, the total amount of electric charge of an electron beam can be controlled by varying the pulse width Pw.

Thus, either modulation method or pulse width modulation may be used for modulating an electron-emitting device in response to an input signal. With voltage modulation, a voltage modulation type circuit is used for the modulation signal generator 127 so that the peak level of the pulse shaped voltage is modulated according to input data, while the pulse width is held constant.

With pulse width modulation, on the other hand, a pulse width modulation type circuit is used for the modulation signal generator 127 so that the pulse width of the applied voltage may be modulated according to input data, while the peak level of the applied voltage is held constant.

Although it is not particularly mentioned above, the shift register 124 and the line memory 125 may be either of digital or of analog signal type so long as serial/parallel conversions and storage of video signals are conducted at a given rate.

If digital signal type devices are used, output signal DATA of the synchronizing signal separation circuit 126 needs to be digitized. However, such conversion can be easily carried out by arranging an A/D converter at the output of the synchronizing signal separation circuit 126. It may be needless to say that different circuits may be used for the modulation signal generator 127 depending on if output signals of the line memory 125 are digital signals or analog signals. If digital signals are used, a D/A converter circuit of a known type may be used for the modulation signal generator 127 and an amplifier circuit may additionally be used, if necessary. As for pulse width modulation, the modulation signal generator 127 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 127 and a level shift circuit may be added thereto if necessary. As for pulse width modulation, a known voltage control type oscillation circuit (VCO) may be used with, if necessary, an additional amplifier to be used for voltage amplification up to the drive voltage of surface-conduction type electron-emitting device.

With an image forming apparatus having a configuration as described above, to which the present invention is applicable, the electron-emitting devices emit electrons as a voltage is applied thereto by way of the external terminals Dox1 through Doxm and doy1 through Doyn. Then, the generated electron beams are accelerated by applying a high voltage to the metal back 35 or a transparent electrode (not shown) by way of the high voltage terminal Hv. The accelerated electrons eventually collide with the fluorescent film 34, which by turn glows to produce images.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

Now, an electron source comprising a plurality of surface conduction electron-emitting devices arranged in a ladder-like manner on a substrate and an image-forming apparatus comprising such an electron source will be described by referring to FIGS. 13 and 14.

Figure 13:
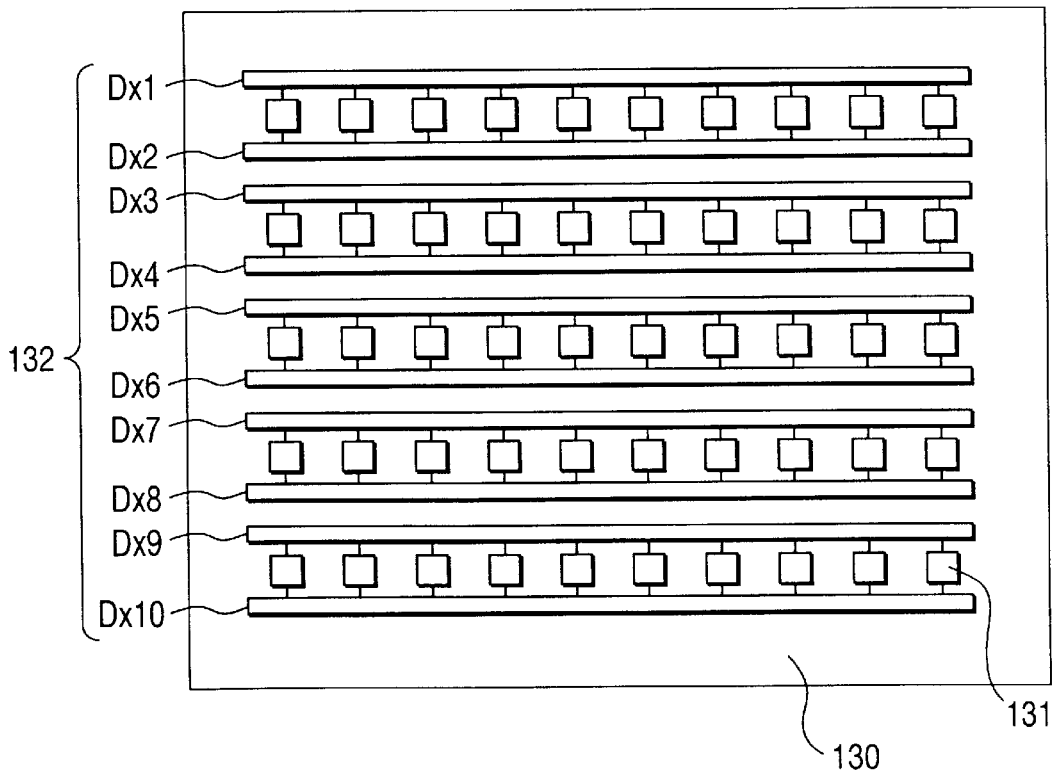
FIG. 13 is a schematic illustration of an electron source having a ladder-like wiring arrangement.

Firstly referring to FIG. 13, reference numeral 130 denotes an electron source substrate and reference numeral 131 denotes an surface conduction electron-emitting device arranged on the substrate, whereas Dx1 through Dx10 denote common wires for connecting the surface conduction electron-emitting devices. The electron-emitting devices 131 are arranged on a substrate 130 in parallel rows along the X-direction (to be referred to as device rows hereinafter) to form an electron source comprising a plurality of device rows, each row having a plurality of devices. The surface conduction electron-emitting devices of each device row are electrically connected in parallel with each other by a pair of common wires so that they can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wire. Thus, of the common wires Dx2 through Dx9, Dx2 and Dx3 can share a single common wire instead of two wires.

Figure 14:
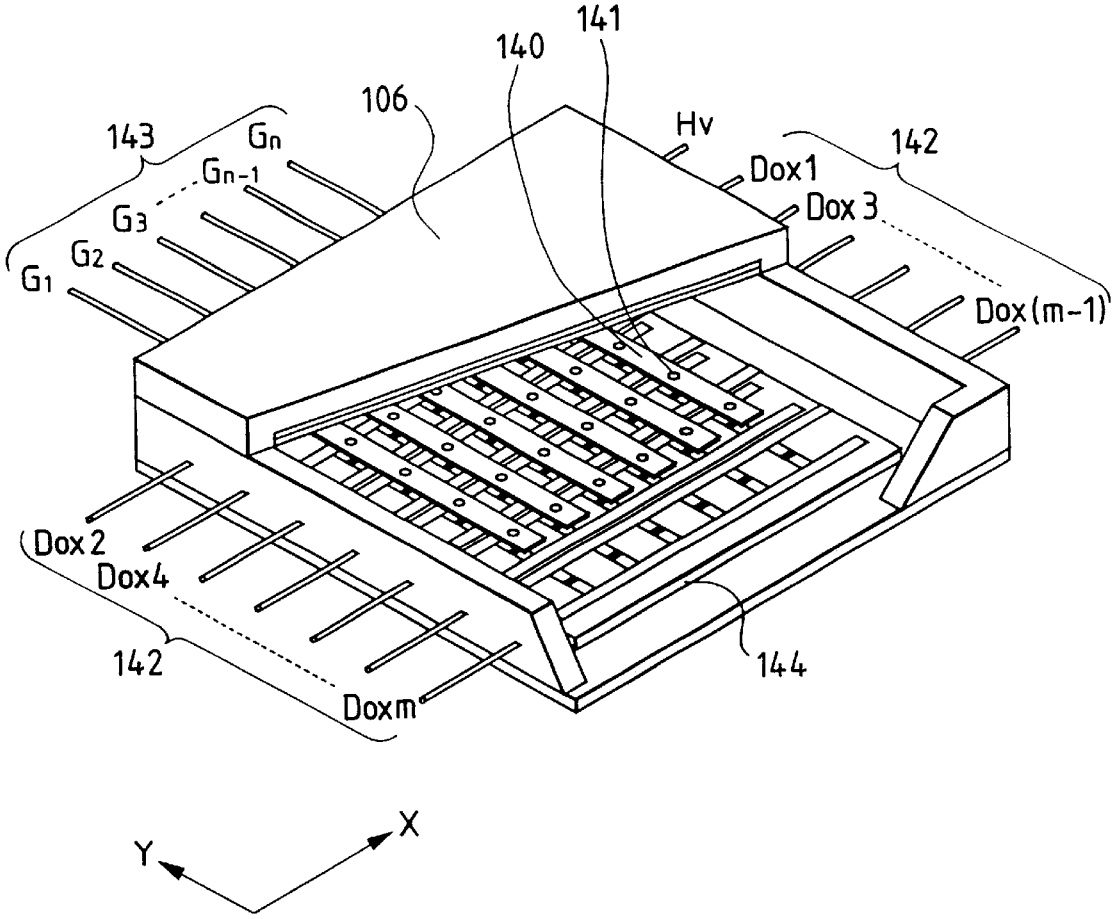
FIG. 14 is a partly cut away schematic perspective view of a display panel that can be used for an image-forming apparatus according to the invention.

FIG. 14 is a schematic perspective view of the display panel of an image-forming apparatus incorporating an electron source having a ladder-like arrangement of electron-emitting devices. In FIG. 14, the display panel comprises grid electrodes 140, each provided with a number of bores 141 for allowing electrons to pass therethrough and a set of external terminals Dox1, Dox2, . . . , Doxm, which are collectively denoted by reference numeral 142, along with another set of external terminals G1, G2, . . . , Gn, which are collectively denoted by reference numeral 143 and connected to the respective grid electrodes 140 and an electron source substrate 144. Note that, in FIG. 14, the components that are similar to those of FIGS. 10 and 13 are respectively denoted by the same reference symbols. The image forming apparatus differs from the image forming apparatus with a simple matrix arrangement of FIG. 10 mainly in that the apparatus of FIG. 14 has grid electrodes 140 arranged between the electron source substrate 130 and the face plate 106.

In FIG. 14, the stripe-shaped grid electrodes 140 are arranged between the substrate 144 and the face plate 106. The grid electrodes 140 are arranged perpendicularly relative to the ladder-like device rows for modulating electron beams emitted from the surface conduction electron-emitting devices, each provided with through bores 141 in correspondence to respective electron-emitting devices for allowing electron beams to pass therethrough. Note that, however, while stripe-shaped grid electrodes are shown in FIG. 14, the profile and the locations of the electrodes are not limited thereto. For example, they may alternatively be provided with mesh-like openings and arranged around or close to the surface conduction electron-emitting devices.

The external terminals 142 and the external terminals for the grids 143 are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

Now, the present invention will be described by way of examples. However, it should be noted that the present invention is not limited thereto and various components may be replaced or altered appropriately within the scope of the invention.

Example 1

The method used in the example to prepare a surface conduction electron-emitting device is essentially same as the one described earlier by referring to FIGS. 1A, 1B, 1C and 1D.

The basic configuration of the device and the method employed for manufacturing it in the example will be described specifically below by referring to FIGS. 1A, 1B, 1C and 1D. The device comprises a substrate 1, a pair of device electrodes 2 and 3, an organic metal film 4*a*, an electroconductive film 4*b* and an electron-emitting region 5.

The steps of the manufacturing the device will be described sequentially below.

Step-a)

After thoroughly cleansing a soda lime glass plate, a silicon oxide film was formed thereon to a thickness of 0.5 μm by sputtering to produce a substrate 1, on which a desired pattern of photoresist (RD-2000N-41: available from Hitachi Chemical Co., Ltd.) having openings corresponding to the contours of a pair of electrodes was formed. Then, a Ti film and a Ni film were sequentially formed to respective thicknesses of 5 nm and 0.1 μm by vacuum evaporation. Thereafter, the photoresist was dissolved by an organic solvent and the unnecessary portions of the Ni/Ti film were lifted off to produce a pair of device electrodes 2 and 3. The device electrodes were separated by distance L=10 μm. (FIG. 1A)

Step-b)

A Cr film was deposited by vacuum evaporation to a thickness of 0.10 μm on the substrate 1 carrying thereon the device electrodes 2 and 3 and a resist pattern having an opening for an electroconductive film 4*b* was prepared with photoresist (AZ1370: available from Hoechst Corporation). Thereafter the Cr of the pattern was etched off. Subsequently, the photoresist pattern was dissolved in an organic solvent and a solution of an organic palladium compound (ccp4230: available from Okuno Pharmaceutical Co., Ltd.) was applied to the cleansed substrate by means of a spinner while rotating the substrate. The applied solution was then left in the atmosphere at room temperature for an hour for drying. For comparison, an organic Pd film was formed on a quartz substrate and dried under the same conditions and thereafter this specimen was tested for the sheet resistance, which was found too high to be measured by the test although obviously it was at least greater than $10^8$ Ω/□. Another specimen was prepared under the same conditions and thereafter baked at 300° C. for 10 minutes to find that the formed film contained Pd as the principal ingredient and had a film thickness of 100 nm and a sheet resistance of $2\times10^2$ Ω/□.

The sheet resistance of the film of this example slightly rose when the sheet resistance of the film was measured while heating it from room temperature to 500° C. but returned to the original level when measured after cooling it back to room temperature to prove that the increase of the resistance was reversible.

Step-c)

The substrate 1 carrying thereon the organic metal film 4*a* of organic Pd was treated with UV/ozone (not shown) at room temperature for 15 minutes by means of an UV/ozone treatment apparatus (UV-300: available from Samco). For comparison, an organic Pd film was formed on a quartz substrate and treated with UV/ozone and thereafter the sheet resistance of the specimen treated with UV/ozone for comparison was tested for the sheet resistance, which was found too high to be measured although obviously it was at least greater than $10^8\Omega/\square$.

Step-d)

The Cr film and the organic metal film 4*a* treated with UV/ozone were lifted off by an acidic etchant to produce a desired pattern of the organic metal film 4*a*.

With the above steps, a pair of device electrodes 2 and 3 and an organic metal film 4*a* were formed on the substrate 1 (FIG. 1B).

Step-e)

Then, the substrate 1 was moved into a clean oven and subjected to an energization forming process by raising the temperature from room temperature to 300° C. at a rate of 10° C./min, while applying a device voltage +Vf to the electron-emitting device from a power source (not shown) (FIG. 1C). The application of the voltage was continued for 10 minutes after the temperature had reached to 300° C. and, after the termination of the voltage application, the specimen was left there to allow it to cool by itself to room temperature. FIG. 3A schematically illustrates the waveform of the voltage Vf used for energization forming.

Referring to FIG. 3A, T1 and T2 respectively denote the pulse width and the pulse interval of the rectangular pulse voltage used for energization forming, which were 1 msec and 10 msec respectively. The wave height of the rectangular pulse voltage (for energization forming) was 12V. During the energization forming process, the electric current flowing through the film 4*a* or 4*b* was observed to find that it was 8 mA at maximum and less than 1 $\mu$A when measured after heating it at 300° C. for 10 minutes.

Step-f)

Subsequently, the device was placed in a gauging system as shown in FIG. 5 and the vacuum chamber was evacuated with a vacuum pump to a pressure level of $1.3\times10^{-6}$ Pa for an activation process. Thereafter, acetone was introduced into the vacuum chamber of the gauging system by opening the slow leak valve until the total pressure rose to $1.3\times10^{-3}$ Pa. A triangular pulse voltage with a height of 14V as shown in FIG. 3A was applied to the device electrode 3 of the device that had been treated for energization forming. In this step, T1 and T2 were respectively 1 msec and 10 msec and the voltage application was terminated 20 minutes after the start, when the device current If was almost saturated. Then, the slow leak valve was closed to finish the activation process.

At this stage of operation, a complete surface conduction electron-emitting device was prepared (FIG. 1D).

Thereafter, the electron-emitting performance of the devices was determined. The vacuum pump unit was switched to an ion pump comprised in it and the sample was heated to 400° C. for 24 hours, keeping the chamber to 200° C., in order to produce an ultravacuum condition and eliminate any organic substances that might be remaining in the vacuum chamber.

The system further comprised an anode for capturing electrons emitted from the surface conduction electron-emitting device, to which a voltage of 4 kV was applied, while keeping the internal pressure of the vacuum chamber to $1.3\times10^{-7}$ Pa. The devices and the anode were separated by a distance of 5 mm.

To observe the device current If and the emission current Ie, a device voltage of 14V was applied to the device electrodes 2 and 3 of the surface conduction electron-emitting device. The device of this example showed If=2.0 mA and Ie=3.6 $\mu$A and operated normally.

The surface conduction electron-emitting device of this example was thermally highly resistant to the high temperature existing in the heating process and consumed little power to produce the electron-emitting region.

Example 2

In this example, the process of Step-a of Example 1 was followed to prepare a pair of device electrodes 2 and 3 on a substrate 1.

Step-b)

An organic metal film 4*a* was formed on the substrate carrying thereon the device electrodes 2 and 3 in a manner as described below.

1 g of ethylene glycol, 0.005 g of polyvinylalcohol and 25 g of IPA were added to 3.2 g of palladium acetate monoethanolamine to prepare 100 g of an aqueous solution thereof, the balance being water. The solution was then applied to a desired location, or the location indicated in FIG. 1B, by means of a bubble-jet type ink-jet apparatus (utilizing part of BJ-10V available from Canon Inc.). For comparison, an organic Pd film was formed on a quartz substrate and dried under the same conditions and thereafter this specimen was tested for the sheet resistance, which was found too high to be measured by the test although obviously it was at least greater than $10^8\ \Omega/\square$. Another specimen was prepared under the same conditions and thereafter baked at 350° C. for 15 minutes to find that the formed film contained Pd as the principal ingredient and had a film thickness of 120 nm and a sheet resistance of $1.5\times10^2\ \Omega/\square$.

The sheet resistance of the film of this example slightly rose when the sheet resistance of the film was measured while heating it from temperature to 500° C. but returned to the original level when measured after cooling it back to room temperature to prove that the increase of the resistance was reversible.

At this stage of operation, the substrate 1 carried thereon a pair of device electrodes 2 and 3 and an organic metal film 4*a*.

Step-c)

Then, the substrate 1 was moved into a clean oven and subjected to an energization forming process by raising the temperature from room temperature to 350° C. at a rate of 10° C./min, while applying a device voltage +Vf to the electron-emitting device from a power source (not shown). The application of the voltage was continued for 15 minutes after the temperature had reached 350° C. and, after the termination of the voltage application, the specimen was left there to allow it to cool by itself to room temperature. FIG. 3A schematically illustrates the waveform of the voltage Vf used for energization forming.

Referring to FIG. 3A, T1 and T2 respectively denote the pulse width and the pulse interval of the triangular pulse voltage used for energization forming, which were 1 msec and 10 msec respectively. The wave height of the triangular pulse voltage (for energization forming) was 12V. During the energization forming process, the electric current flowing through the film 4*a* or 4*b* was observed to find that it was 6 mA at maximum and less than 1 $\mu$A when measured after heating it at 350° C. for 15 minutes.

Step-d)

Subsequently, the device was placed in a gauging system as shown in FIG. 5 and the vacuum chamber was evacuated with a vacuum pump to a pressure level of $1.3\times10^{-6}$ Pa for an activation process. Thereafter, acetone was introduced into the vacuum chamber of the gauging system by opening the slow leak valve until the total pressure rose to $1.3\times10^{-3}$ Pa. A triangular pulse voltage with a height of 14V as shown in FIG. 3A was applied to the device electrode 3 of the device that had been treated for energization forming. In this step, T1 and T2 were respectively 1 msec and 10 msec and the voltage application was terminated 20 minutes after the start, when the device current If was almost saturated. Then, the slow leak valve was closed to finish the activation process.

At this stage of operation, a complete surface conduction electron-emitting device was prepared.

Thereafter, the electron-emitting performance of the devices was determined with the above described gauging system. The vacuum chamber was evacuated by means of an ultravacuum exhaust unit in this example and the s ample was heated to 400° C. for 24 hours, keeping the chamber to 200° C., in order to produce an ultravacuum condition and eliminate any organic substances that might be remaining in the vacuum chamber.

A voltage of 4 kV was applied to the anode 54 of FIG. 5, while keeping the internal pressure of the vacuum chamber to $1.3\times10^{-7}$ Pa. The devices and the anode were separated by a distance of 5 mm.

To observe the device current If and the emission current Ie, a device voltage of 14V was applied to the device electrodes 2 and 3 of the surface conduction electron-emitting device. The device of this example showed If=2.5 mA and Ie=4.0 $\mu$A and operated normally.

The surface conduction electron-emitting device of this example was thermally highly resistant to the high temperature existing in the heating process and consumed little power to produce the electron-emitting region.

Example 3

The method used in the example to prepare a surface conduction electron-emitting device is essentially same as the one described earlier by referring to FIGS. 1A, 1B, 2A, 2B and 2C.

The basic configuration of the device and the method employed for manufacturing it in the example will be described specifically below by referring to FIGS. 1A, 1B, 2A, 2B and 2C. There are shown a substrate 1, a pair of device electrodes 2 and 3, an organic metal film 4*a*, a second electroconductive film 4*b* obtained by decomposing the organic metal film 4*a*, a first electroconductive film 4*b*', an electron-emitting region 5 formed in the second electroconductive film and a gap 5' produced in the first electroconductive film.

The steps of the manufacturing the device will be described sequentially below also by referring to FIGS. 1A, 1B, 2A, 2B and 2C.

Step-a)

Step-a of Example 1 was followed in this example.

Step-b)

A Cr film was deposited by vacuum evaporation to a thickness of 0.1 $\mu$m on the substrate 1 carrying thereon the device electrode 2 and 3 and a resist pattern for a first electroconductive film 4*b*' was prepared with photoresist (AZ1370: available from Hoechst Corporation). Thereafter the Cr of the pattern was etched off. Subsequently, the photoresist pattern was dissolved into an organic solvent and a solution of an organic palladium compound (ccp4230: available from Okuno Pharmaceutical Co., Ltd.) was applied to the cleansed substrate to actually produce the first electroconductive film 4*b*' by means of a spinner while rotating the substrate. The first electroconductive film 4*b*' was made of fine particles containing Pd as the principal ingredient and had a film thickness of 10 nm.

Step-c)

After baking and producing the first electroconductive film 4*b*', the Cr film was etched out by means of an acidic etchant, and the first electroconductive film 4*b*' patterned by lift off technique.

Step-d)

Figure 3B:
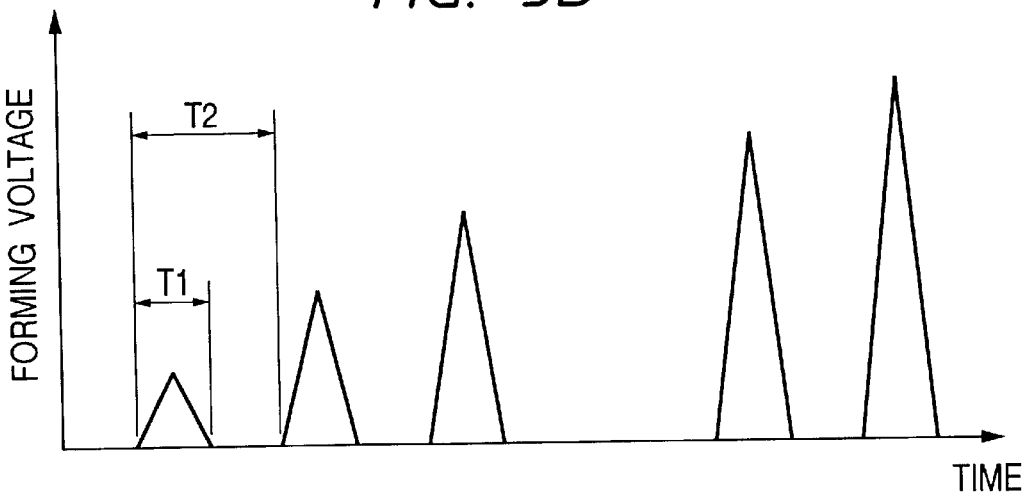

Then, the substrate 1 was moved into a clean oven and the inside of it was evacuated by means of a vacuum pump to a pressure level of $1.3\times10^{-5}$ Pa. Thereafter, the device was subjected to formation of a fissure 5' by applying a device voltage +Vf to the device electrode 3 from a power source (not shown). FIG. 3B schematically illustrates the waveform of the voltage Vf used for this step.

Referring to FIG. 3B, T1 and T2 respectively denote the pulse width and the pulse interval of the triangular pulse voltage used for this step, which were 1 msec and 10 msec respectively. The wave height of the triangular pulse voltage was raised stepwise by 0.1V. During this step, a resistance measuring pulse voltage was inserted in the pulse interval T2 to observe the resistance of the device. The voltage application was terminated when the resistance exceeded 1MΩ as observed by means of the resistance measuring pulse.

Step-e)

After the above operation, the substrate was taken out of the gauging system and an organic metal film 4*a* was formed on the substrate in a manner as described below.

1 g of ethylene glycol, 0.005 g of polyvinylalcohol and 25 g of IPA were added to 3.2 g of palladium acetate monoethanolamine to prepare 100 g of an aqueous solution thereof, the balance being water. The solution was then applied to a desired location, or the location riding on the first electroconductive film 4*b*' (FIG. 2B), by means of a bubble-Jet type ink-Jet apparatus. For comparison, an organic Pd film was formed on a quartz substrate and dried under the same conditions and thereafter this specimen was tested for the sheet resistance, which was found too high to be measured by the test although obviously it was at least greater than $10^8$ Ω/□. Another specimen was prepared under the same conditions and thereafter baked at 350° C. for 15 minutes to find that the formed film contained Pd as principal ingredient and had a film thickness of 120 nm and a sheet resistance of $1.5\times10^2$ Ω/□.

The sheet resistance of the film of this example slightly rose when the sheet resistance of the film was measured while heating it from room temperature to 500° C. but returned to the original level when measured after cooling it back to room temperature to prove that the increase of the resistance was reversible.

At this stage of operation, the substrate 1 carried thereon a pair of device electrodes 2 and 3, a first electroconductive film 4*b*' and an organic metal film 4*a*.

Step-f)

Then, the substrate 1 was moved into a clean oven and subjected to an energization forming process by raising the temperature from room temperature to 350° C. at a rate of 10° C./min, while applying a device voltage +Vf to the electron-emitting device from a power source (not shown). The application of the voltage was continued for 15 minutes after the temperature had reached to 350° C. and, after the termination of the voltage application, the specimen was left there to allow it to be cooled by itself to room temperature. FIG. 3A schematically illustrates the waveform of the voltage Vf used for energization forming.

Referring to FIG. 3A, T1 and T2 respectively denote the pulse width and the pulse interval of the rectangular pulse voltage used for energization forming, which were 1 msec and 10 msec respectively. The wave height of the triangular pulse voltage was 12V. During the energization forming process, the electric current flowing through the film 4*a* or 4*b*' was observed to find that it was 6 mA at maximum and less than 1 $\mu$A when measured after heating it at 350° C. for 15 minutes.

Step-g)

Subsequently, the device was placed back in the gauging system and the vacuum chamber was evacuated with a vacuum pump to a pressure level of $1.3\times10^{-6}$ Pa for an activation process. Thereafter, acetone was introduced into the vacuum chamber of the gauging system by opening the slow leak valve until the total pressure rose to $1.3\times10^{-3}$ Pa. A triangular pulse voltage with a height of 14V as shown in FIG. 3A was applied to the device electrode 3 of the device that had been treated for energization forming. In this step, T1 and T2 were respectively 1 msec and 10 msec and the voltage application was terminated 20 minutes after the start, when the device current If was almost saturated. Then, the slow leak valve was closed to finish the activation process.

At this stage of operation, a complete surface conduction electron-emitting device was prepared.

Thereafter, the electron-emitting performance of the devices was determined with the above described gauging system. The vacuum chamber was evacuated by means of an ultrahigh vacuum exhaust unit in this example and the sample was heated to 400° C. for 24 hours, keeping the chamber at 200° C., in order to produce an ultravacuum condition and eliminate any organic substances that might be remaining in the vacuum chamber.

A voltage of 4 kV was applied to the anode 54 of FIG. 5, while keeping the internal pressure of the vacuum chamber to $1.3\times10^{-7}$ Pa. The devices and the anode were separated by a distance of 5 mm.

To observe the device current If and the emission current Ie, a device voltage of 14V was applied to the device electrodes 2 and 3 of the surface conduction electron-emitting device. The device of this example showed If=3.0 mA and Ie=4.5 $\mu$A and operated normally.

The surface conduction electron-emitting device of this example was thermally highly resistant to the high temperature existing in the heating process and consumed little power to produce the electron-emitting region.

When the devices of Examples 2 and 3 were observed with a scanning electron microscope (SEM), the position of the electron-emitting region was found to vary between the device electrodes 2 and 3 in both cases, although the variation was by far smaller in Example 3 than in Example 2, suggesting that the procedure of Example 3 is preferable when manufacturing a large number of devices that operate uniformly for electron emission.

Example 4

In this example, the process of Step-a of Example 1 was followed to prepare a pair of device electrodes 2 and 3 on a substrate 1.

Step-b)

Subsequently, a dichloromethane solution of dodecacarbonyltetrairidium was applied onto a cleansed substrate by means of a spinner, while rotating the substrate. For comparison, a film of the Ir compound was formed on a quartz substrate and dried under the same conditions and thereafter this specimen was tested for the sheet resistance, which was found too high to be measured by the test although obviously it was at least greater than $10^8$ Ω/□. Another specimen was prepared under the same conditions and thereafter baked at 300° C. for 10 minutes to find that the formed film contained Ir as the principal ingredient and had a film thickness of 5 nm and a sheet resistance of $1\times10^4$ Ω/□.

The sheet resistance of the film of this example slightly rose when the sheet resistance of the film was measured while heating it from temperature to 500° C. but returned to the original level when measured after cooling it back to room temperature to prove that the increase of the resistance was reversible.

Step-c)

Then, the substrate 1 carrying an organic metal film 4*a*, or a film of an Ir complex, was trimmed to show a profile as shown in FIG. 1B by means of a laser machine (not shown).

At this stage of operation, the substrate 1 carried thereon a pair of device electrodes 2 and 3 and an organic metal film 4*a*.

Step-d)

Then, the substrate 1 was moved into a clean oven and subjected to an energization forming process by raising the temperature from room temperature to 250° C. at a rate of 10° C./min, while applying a device voltage +Vf to the electron-emitting device from a power source (not shown). The application of the voltage was continued for 30 minutes after the temperature had reached to 250° C. and, after the termination of the voltage application, the specimen was left there to allow it to be cooled by itself to room temperature. FIG. 3A schematically illustrates the waveform of the voltage Vf used for energization forming.

Referring to FIG. 3A, T1 and T2 respectively denote the pulse width and the pulse interval of the rectangular pulse voltage used for energization forming, which were 1 msec and 10 msec respectively. The wave height of the triangular pulse voltage was 12V. During the energization forming process, the electric current flowing through the film 4 was observed to find that it was 10 mA at maximum and less than 1 $\mu$A when measured after heating it at 250° C. for 30 minutes.

Step-e)

Subsequently, the device was placed in a gauging system and the vacuum chamber was evacuated with a vacuum pump to a pressure level of $1.3\times10^{-6}$ Pa for an activation process. Thereafter, acetone was introduced into the vacuum chamber of the gauging system by opening the slow leak valve until the total pressure rose to $1.3\times10^{-3}$ Pa. A triangular pulse voltage with a height of 14V as shown in FIG. 3A was applied to the device electrode 3 of the device that had been treated for energization forming. In this step, T1 and T2 were respectively 1 msec and 10 msec and the voltage application was terminated 20 minutes after the start, when the device current If was almost saturated. Then, the slow leak valve was closed to finish the activation process.

At this stage of operation, a complete surface conduction electron-emitting device was prepared.

Thereafter, the electron-emitting performance of the devices was determined with the above described gauging system. The vacuum chamber was evacuated by means of an ultravacuum exhaust unit in this example and the sample was heated to 400° C. for 24 hours, keeping the chamber at 200° C., in order to produce an ultravacuum condition and eliminate any organic substances that might be remaining in the vacuum chamber.

A voltage of 4 kV was applied to the anode 54 of FIG. 5, while keeping the internal pressure of the vacuum chamber to $1.3\times10^{-7}$ Pa. The devices and the anode were separated by a distance of 5 mm.

To observe the device current If and the emission current Ie, a device voltage of 14V was applied to the device electrodes 2 and 3 of the surface conduction electron-emitting device. The device of this example showed If=2.2 mA and Ie=4.0 $\mu$A and operated normally.

The surface conduction electron-emitting device of this example was thermally highly resistant to the high temperature existing in the heating process and consumed little power to produce the electron-emitting region.

Example 5

In this example, the process of Steps-a through d of Example 3 were followed to prepare a pair of device electrodes 2 and 3 and a first electroconductive film 4*b*' on a substrate 1.

Step-e)

Subsequently, the substrate was taken out of the gauging system and a dichloromethane solution of dodecacarbonyltetrairidium was applied onto a cleansed substrate by means of a spinner, while rotating the substrate, to produce an organic metal film 4*a*. For comparison, a film of the Ir compound was formed on a quartz substrate and dried under the same conditions and thereafter this specimen was tested for the sheet resistance, which was found too high to be measured by the test although obviously it was at least greater than $10^8$ Ω/□. Another specimen was prepared under the same conditions and thereafter baked at 300° C. for 10 minutes to find that the formed film contained Ir as the principal ingredient and had a film thickness of 5 nm and a sheet resistance of $1\times10^4$ Ω/□.

The sheet resistance of the film of this example slightly rose when the sheet resistance of the film was measured while heating it from room temperature to 500° C. but returned to the original level when measured after cooling it back to room temperature to prove that the increase of the resistance was reversible.

Step-f)

Then, the organic metal film 4*a*, or the film of the Ir compound, was trimmed to show a profile as shown in FIG. 1B by means of a laser machine (not shown).

At this stage of operation, the substrate 1 carried thereon a pair of device electrodes 2 and 3 and an organic metal film 4*a*.

Step-g)

Then, the substrate 1 was moved into a clean oven and subjected to an energization forming process by raising the temperature from room temperature to 250° C. at a rate of 10° C./min, while applying a device voltage +Vf to the electron-emitting device from a power source (not shown). The application of the voltage was continued for 30 minutes after the temperature had reached to 250° C. and, after the termination of the voltage application, the specimen was left there to allow it to cool by itself to room temperature. FIG. 3A schematically illustrates the waveform of the voltage Vf used for energization forming.

Referring to FIG. 3A, T1 and T2 respectively denote the pulse width and the pulse interval of the rectangular pulse voltage used for energization forming, which were 1 msec and 10 msec respectively. The wave height of the triangular pulse voltage was 12V. During the energization forming process, the electric current flowing through the film 4*a* or 4*b*' was observed to find that it was 8 mA at maximum and less than 1 $\mu$A when measured after heating it at 250° C. for 30 minutes.

Step-h)

Subsequently, the device was placed in a gauging system and the vacuum chamber was evacuated with a vacuum pump to a pressure level of $1.3\times10^{-6}$ Pa for an activation process. Thereafter, acetone was introduced into the vacuum chamber of the gauging system by opening the slow leak valve until the total pressure rose to $1.3\times10^{-3}$ Pa. A rectangular pulse voltage with a height of 14V as shown in FIG. 3A was applied to the device electrode 3 of the device that had been treated for energization forming. In this step, T1 and T2 were respectively 1 msec and 10 msec and the voltage application was terminated 20 minutes after the start, when the device current If was almost saturated. Then, the slow leak valve was closed to finish the activation process.

At this stage of operation, a complete surface conduction electron-emitting device was prepared.

Thereafter, the electron-emitting performance of the devices was determined with the above described gauging system. The vacuum chamber was evacuated by means of an ultrahigh vacuum exhaust unit comprising an ion pump not using vacuum oil and the sample was heated at 400° C. for 24 hours, keeping the chamber to 200° C., in order to produce an ultrahigh vacuum condition and eliminate any organic substances that might be remaining in the vacuum chamber.

A voltage of 4 kV was applied to the anode 54 of FIG. 5, while keeping the internal pressure of the vacuum chamber to $1.3\times10^{-7}$ Pa. The devices and the anode were separated by a distance of 5 mm.

To observe the device current If and the emission current Ie, a device voltage of 14V was applied to the device electrodes 2 and 3 of the surface conduction electron-emitting device. The device of this example showed If=2.8 mA and Ie=4.5 $\mu$A and operated normally.

The surface conduction electron-emitting device of this example was thermally highly resistive to the high temperature existed in the heating process and consumed little power to produce the electron-emitting region.

Example 6

In this example, the process of Steps-a and b of Example 2 were followed to prepare a pair of device electrodes 2 and 3 and an organic metal film 4*a* on a substrate 1.

Step-c)

Then, the substrate 1 was moved into a vacuum oven whose internal pressure is reducible by means of a vacuum pump and the oven was exhausted to about 10 Pa before the atmosphere in the oven was replaced by helium. Subsequently, the device was subjected to an energization forming process in the atmosphere of 10 Pa by raising the temperature from room temperature to 350° C. at a rate of 10° C./min, while applying a device voltage +Vf to the electron-emitting device from a power source (not shown). The application of the voltage was continued for 30 minutes after the temperature had reached 350° C. and, after the termination of the voltage application, the specimen was left there to allow it to cool by itself to room temperature. FIG. 3A schematically illustrates the waveform of the voltage Vf used for energization forming.

Referring to FIG. 3A, T1 and T2 respectively denote the pulse width and the pulse interval of the triangular pulse voltage used for energization forming, which were 1 mesc and 10 mesc respectively. The wave height of the triangular pulse voltage was 14V. During the energization forming process, the electric current flowing through the film 4*a* or 4*b* was observed to find that it was 6 mA at maximum and less than 1.5 mA when measured after heating it at 350° C. for 30 minutes.

Another specimen prepared in the same way was observed with a SEM to find a deposit on the electron-emitting region 5 and in the vicinity of it. When the deposit was subjected to Auger electron spectrometry for elemental analysis, it was found to contain carbon as the principal ingredient.

For the purpose of comparison, another specimen was prepared by conducting a heating and electrically energizing process in the atmosphere and observed with a SEM to find that no deposit had been formed on and near the electron-emitting region 5. Step-d)

Thereafter, the prepared surface conduction electron-emitting device was placed in a gauging system to determine the electron-emitting performance of the devices. The vacuum chamber was evacuated by means of an ultrahigh vacuum exhaust unit and the sample was heated to 400° C. for 24 hours, keeping the inside of the vacuum chamber to 200° C. and $1.3\times10^{-7}$ Pa.

A voltage of 4 kV was applied to the anode 54 of FIG. 5. The devices and the anode were separated by a distance of 5 mm.

To observe the device current If and the emission current Ie, a device voltage of 14V was applied to the device electrodes 2 and 3 of the surface conduction electron-emitting device. The device of this example showed If=1.5 mA and Ie=2.5 $\mu$A and operated normally.

The surface conduction electron-emitting device of this example was thermally highly resistant to the high temperature existing in the heating process and consumed little power to produce the electron-emitting region. Additionally, the manufacturing process was simplified because the energization forming step and the activation step were carried out simultaneously.

Example 7

In this example, Step-c of Example 6 was followed in the vacuum system used in Step-d of Example 2 to reduce the internal pressure to $1.3\times10^{-6}$ Pa and then the specimen was subjected to a process of heating and voltage application as in Example 6. Otherwise, the steps of Example 6 were followed. The energy consumption for energization forming and the performance of the prepared device were practically the same as those of the specimen of Example 6.

The above step was conducted in an acetone-containing atmosphere as in Step-e of Example 2, although the temperature of 350° C. was maintained only for 15 minutes, or a half of the corresponding time in Example 6, to produce a device substantially the same as its counterpart of Example 6. Presumably, the deposition of carbon and/or carbon compounds was accelerated as additional carbon was supplied from the acetone in the atmosphere.

Example 8

In this example, the process of Step-a of Example 1 was followed to prepare a pair of device electrodes 2 and 3 on a substrate 1.

Step-b)

Subsequently, a chloromethane solution of hexacarbonyl-bis-(η-cyclopentadiene)-ditungsten was applied onto a cleansed substrate by means of a spinner, while rotating the substrate. For comparison, a film of the W compound was formed on a quartz substrate and dried under the same conditions and thereafter this specimen was tested for the sheet resistance, which was found too high to be measured by the test although obviously it was at least greater than $10^8$ Ω/□. Another specimen was prepared under the same conditions and thereafter baked at 300° C. for 10 minutes to find that the formed film contained Ir as the principal ingredient and had a film thickness of 5 nm and a sheet resistance of $1\times10^3$ Ω/□.

The sheet resistance of the film of this example slightly rose when the sheet resistance of the film was measured while heating it from room temperature to 500° C. but returned to the original level when measured after cooling it back to room temperature to prove that the increase of the resistance was reversible.

Step-c)

Then, the organic metal film 4*a*, or the film of the W compound, was trimmed to show a profile as shown in FIG. 1B by means of a laser machine (not shown).

At this stage of operation, the substrate 1 carried thereon a pair of device electrodes 2 and 3 and an organic metal film 4*a*.

Step-d)

Then, the substrate 1 was moved into a vacuum oven, which was exhausted to about 10 Pa before the atmosphere in the oven was replaced by helium. Thereafter, the device was subjected to an energization forming process by raising the temperature from room temperature to 300° C. at a rate of 10° C./min, while applying a device voltage +Vf to the electron-emitting device from a power source (not shown). The application of the voltage was continued for 30 minutes after the temperature had reached 300° C. and, after the termination of the voltage application, the specimen was left there to allow it to cool by itself to room temperature. FIG. 3A schematically illustrates the waveform of the voltage Vf used for energization forming.

Referring to FIG. 3A, T1 and T2 respectively denote the pulse width and the pulse interval of the triangular pulse voltage used for energization forming, which were 1 mesc and 10 mesc respectively. The wave height of the triangular pulse voltage was 14V. During the energization forming process, the electric current flowing through the film 4*a* or 4*b*' was observed to find that it was 10 mA at maximum and 1.0 mA when measured after heating it at 300° C. for 30 minutes.

Another specimen prepared in the same way was observed with a SEM to find a deposit on the electron-emitting region 5 and in the vicinity of it. When the deposit was subjected to Auger electron spectrometry for elemental analysis, it was found to contain carbon as the principal ingredient.

For the purpose of comparison, another specimen was prepared by conducting a heating and electrically energizing process in the atmosphere and observed with a SEM to find that no electron-emitting region was formed probably due to insulating property of tungsten oxide.

Step-e) Thereafter, the electron-emitting performance of the devices was determined with the above described gauging system. The vacuum chamber was evacuated by means of an ultrahigh vacuum exhaust unit comprising an ion pump not using vacuum oil and the sample was heated at 400° C. for 24 hours, keeping the chamber to 200° C., in order to produce a vacuum condition eliminating any organic substances that might be remaining in the vacuum chamber.

A voltage of 4 kV was applied to the anode 54 of FIG. 5, while keeping the internal pressure of the vacuum chamber to $1.3\times10^{-7}$ Pa. The devices and the anode were separated by a distance of 5 mm.

To observe the device current If and the emission current Ie, a device voltage of 14 V was applied between the device electrodes 2 and 3 of the surface conduction electron-emitting device. The device of this example showed If=1.0 mA and Ie=2.0 $\mu$A and operated normally.

The surface conduction electron-emitting device of this example was thermally highly resistant to the high temperature existing in the heating process and consumed little power to produce the electron-emitting region. The manufacturing process was simplified as in the case of Example 6.

Comparative Example 1

In this example, Steps-a through e of Example 1 were followed to prepare a pair of device electrodes 2 and 3 and an electroconductive film 4*b* on a substrate 1 except that the organic metal film 4*a* was not electrically energized in the baking process.

Step-f)

Subsequently, the device was placed in a gauging system and the vacuum chamber was evacuated with a vacuum pump to a pressure level of $1.3\times10^{-6}$ Pa. Thereafter, an energization forming process was conducted by applying a device voltage +Vf to the electron-emitting device from a power source (not shown). FIG. 3B shows the waveform of the voltages used for the energization forming process.

Referring to FIG. 3B, T1 and T2 respectively denote the pulse width and the pulse interval of the triangular pulse voltage used for energization forming, which were 1 mesc and 10 msec respectively. The wave height of the triangular pulse voltage was raised stepwise by 0.1 V. During the energization forming process, a resistance measuring pulse voltage was inserted in the pulse interval T2 to observe the resistance of the device. The voltage application was terminated when the resistance exceeded 1 MΩ as observed by means of the resistance measuring pulse. The voltage and the maximum current observed during the energization forming process were 10.5 V and 50 mA respectively.

Step-g)

Subsequently, acetone was introduced into the vacuum chamber of a gauging system by opening the slow leak valve until the total pressure rose to $1.3\times10^{-3}$ Pa. A triangular pulse voltage with a height of 14 V as shown in FIG. 3A was applied to the device electrode 3 of the device that had been treated for energization forming. In this step, T1 and T2 were respectively 1 mesc and 10 msec and the voltage application was terminated 20 minutes after the start, when the device current If was almost saturated. Then, the slow leak valve was closed to finish the activation process.

At this stage of operation, a complete surface conduction electron-emitting device was prepared.

Thereafter, the electron-emitting performance of the devices was determined with the above described gauging system. The vacuum chamber was evacuated by means of an ultrahigh vacuum exhaust unit in this example and the sample was heated to 400° C. for 24 hours, keeping the chamber to 200° C., in order to produce a vacuum condition eliminating any organic substances that might be remaining in the vacuum chamber.

A voltage of 4 kV was applied to the anode 54 of FIG. 5, while keeping the internal pressure of the vacuum chamber to $1.3\times10^{-7}$ Pa. The devices and the anode were separated by a distance of 5 mm.

To observe the device current If and the emission current Ie, a device voltage of 14 V was applied to the device electrodes 2 and 3 of the surface conduction electron-emitting device. The device of this example showed If=2.0 mA and Ie=3.6 $\mu$A and operated normally.

While the surface conduction electron-emitting device of this comparative example operated normally for electron emission, it consumed power about five times as much as its counterpart of Example 1 for energization forming.

Comparative Example 2

In this comparative example, Steps-a through e of Comparative Example 1 were followed to produce a pair of device electrodes 2 and 3 and an electroconductive film 4*b* on a substrate 1. The-conditions for forming an organic metal film were so regulated that the obtained electroconductive film 4*b* had a film thickness of 10 nm.

Another specimen of film was prepared like the electroconductive film 4*b* in order to evaluate the electric performance by observing its sheet resistance, while heating it from room temperature to 500° C. The resistance showed an abrupt rise around 230° C. and was unmeasurable at 400° C. When cooled to room temperature, the electric resistance of the film remained high.

Step-f)

Subsequently, the device was placed in a gauging system and the vacuum chamber was evacuated with a vacuum pump to a pressure level of $1.3\times10^{-6}$ Pa. Thereafter, an energization forming process was conducted by applying a device voltage +Vf to the electron-emitting device from a power source (not shown). FIG. 3B shows the waveform of the voltages used for the energization forming process.

Referring to FIG. 3B, T1 and T2 respectively denote the pulse width and the pulse interval of the triangular pulse voltage used for energization forming, which were 1 mesc and 10 mesc respectively. The wave height of the triangular pulse voltage was raised stepwise by 0.1 V. During the energization forming process, a resistance measuring pulse voltage was inserted in the pulse interval T2 to observe the resistance of the device. The voltage application was terminated when the resistance exceeded 1 MΩ as observed by means of the resistance measuring pulse. The voltage and the maximum current observed during the energization forming process were 10.8 V and 12 mA respectively.

Step-g)

Subsequently, acetone was introduced into the vacuum chamber of a gauging system by opening the slow leak valve until the total pressure rose to $1.3\times10^{-3}$ Pa. A rectangular pulse voltage with a height of 14 V as shown in FIG. 3A was applied to the device electrode 3 of the device that had been treated for energization forming. In this step, T1 and T2 were respectively 1 mesc and 10 mesc and the voltage application was terminated 20 minutes after the start, when the device current If was almost saturated. Then, the slow leak valve was closed to finish the activation process.

At this stage of operation, a complete surface conduction electron-emitting device was prepared.

Thereafter, the electron-emitting performance of the devices was determined with the above described gauging system. The vacuum chamber was evacuated by means of an ultrahigh vacuum exhaust unit in this example and the sample was heated to 200° C. for 24 hours, keeping the chamber at 200° C., in order to produce a vacuum condition eliminating any organic substances that might be remaining in the vacuum chamber.

A voltage of 4 kV was applied to the anode 54 of FIG. 5, while keeping the internal pressure of the vacuum chamber to $1.3\times10^{-6}$ Pa. The devices and the anode were separated by a distance of 5 mm.

To observe the device current If and the emission current Ie, a device voltage of 14 V was applied between the device electrodes 2 and 3 of the surface conduction electron-emitting device. The device of this example showed If=1.8 mA and Ie=1.7 μA and operated normally, but as compared with the device of Example 2, the decrease of emission current Ie during continuous speration was larger.

Another specimen of surface conduction electron-emitting device was prepared in the same way and the electron-emitting performance of the device was observed in the above described gauging system. The vacuum chamber was evacuated and the sample was heated to 400° C. for 24 hours, keeping the chamber to 200° C., in order to eliminate any organic substances that might be remaining in the vacuum chamber.

To observe the device current If and the emission current Ie, a device voltage of 14 V was applied to the device electrodes 2 and 3 of the specimen. While the specimen showed If=1.8 mA and Ie=3.4 μA at the beginning of the observation, both If and Ie fell with time and no emission current was observed 10 minutes after the start of the measurement.

The device of this comparative example consumed a large amount of power for energization forming compared with that of Example 1 and did not operate properly for electron emission if treated at high temperature.

Comparative Example 3

In this example, Steps-a through e of Example 4 were followed to prepare a pair of device electrodes 2 and 3 and an electroconductive film 4*b* on a substrate 1 except that the organic metal film 4*a* was not electrically energized in the baking process.

Step-f)

Subsequently, the device was placed in a gauging system and the vacuum chamber was evacuated with a vacuum pump to a pressure level of $1.3\times10^{-6}$ Pa. Thereafter, an energization forming process was conducted by applying a device voltage +Vf to the electron-emitting device from a power source (not shown). FIG. 3B shows the waveform of the voltages used for the energization forming process.

Referring to FIG. 3B, T1 and T2 respectively denote the pulse width and the pulse interval of the triangular pulse voltage used for energization forming, which were 1 mesc and 10 msec respectively. The wave height of the triangular pulse voltage was raised stepwise by 0.1 V but no energization forming took place when the voltage was raised to 30 V.

No energization forming process could be conducted on the device of the comparative example under ordinary conditions.

Example 9

In this example, an image-forming apparatus comprising a large number of surface conduction electron-emitting devices arranged in a simple matrix was prepared.

Figure 15:
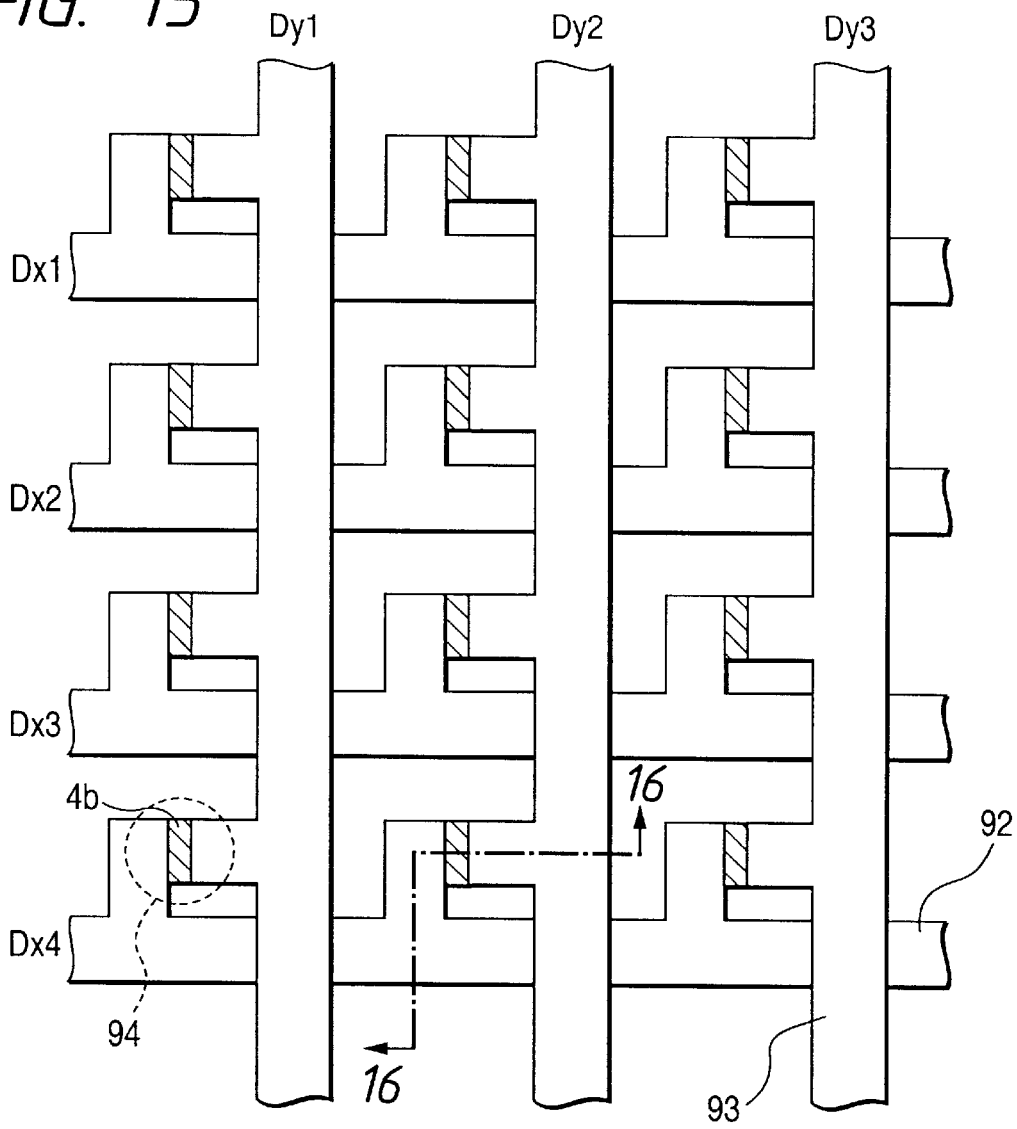
FIG. 15 is a schematic partial plan view of the electron source with a matrix wiring arrangement of Example 10.
Figure 16:
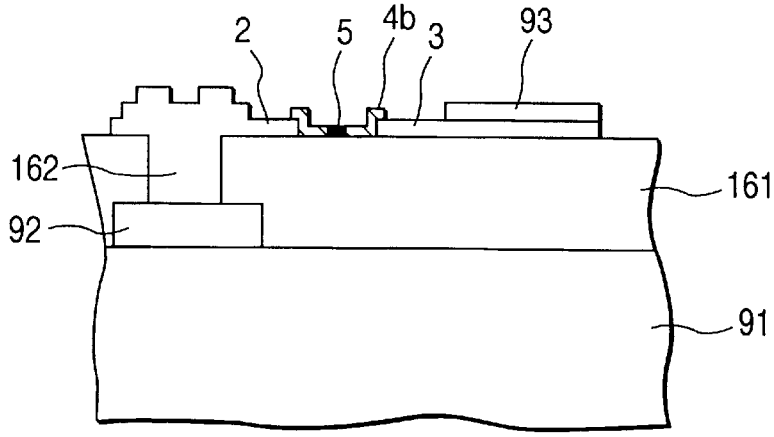
FIG. 16 is a schematic cross sectional view of the electron source of FIG. 15 taken along line 16—16.

FIG. 15 is a schematic partial plan view of the electron source of the image-forming apparatus and FIG. 16 is a schematic cross sectional view taken along line 16—16 of FIG. 15. Note that the same components in FIGS. 15 and 16 are denoted respectively by the same reference symbols. In these figures, 91 denotes X-directional wires (which may be called lower wires) that correspond respectively to wires Dx1 through Dxm of FIG. 9 and 92 denotes Y-directional wires (which may be called upper wires) that correspond respectively to wires Dy1 through Dyn of FIG. 9. Otherwise, the electron source comprises electron-emitting devices, each having an electroconductive film 4 including an electron-emitting region and a pair of device electrodes 2 and 3, an interlayer insulation layer 161 and a number of contact holes 162, each of which is used to connect a device electrode 2 with a related lower wire 92.

Now, the steps of manufacturing the electron source of this example will be described in detail by referring to FIGS. 17A, 17B, 17C, 17D, 17E, 17F, 17G and 17H.

Figure 17A:
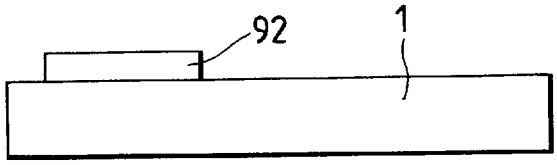
FIGS. 17A, 17B, 17C, 17D, 17E, 17F, 17G and 17H are schematic partial sectional views of the electron source of Example 10, illustrating different manufacturing steps.

Step-a (FIG. 17A)

After thoroughly cleansing a soda lime glass plate and forming a silicon oxide film with a film thickness of 0.5 μm by sputtering, Cr and Au were sequentially laid to thicknesses of 5 nm and 0.6 μm respectively and then a photoresist (AZ1370: available from Hoechst Corporation) was formed thereon by means of a spinner, while rotating the film, and baked. Thereafter, a photomask image was exposed to light and developed to produce a resist pattern for lower wires 92 and then the deposited Au/Cr film was wet-etched to produce lower wires 92 having a desired profile.

Figure 17B:
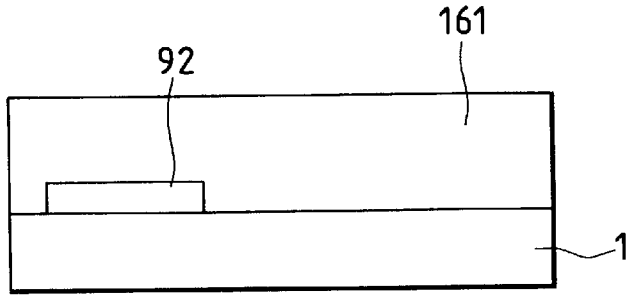

Step-b (FIG. 17B)

A silicon oxide film was formed as an interlayer insulation layer 161 to a thickness of 0.1 μm by RF sputtering.

Figure 17C:
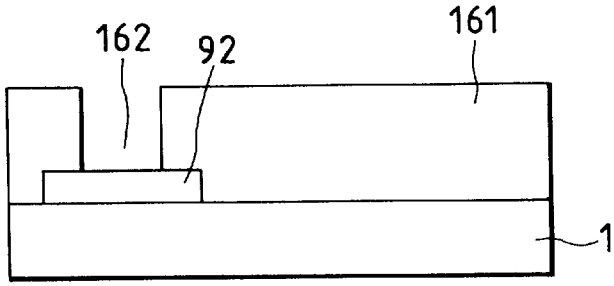

Step-c (FIG. 17C)

A photoresist pattern was prepared for producing contact holes 162 in the silicon oxide film deposited in Step-b, which contact holes 162 were then actually formed by etching the interlayer insulation layer 161, using the photoresist pattern for a mask. RIE (Reactive Ion Etching) using $CF_4$ and $H_2$ gas was employed for the etching operation.

Figure 17D:
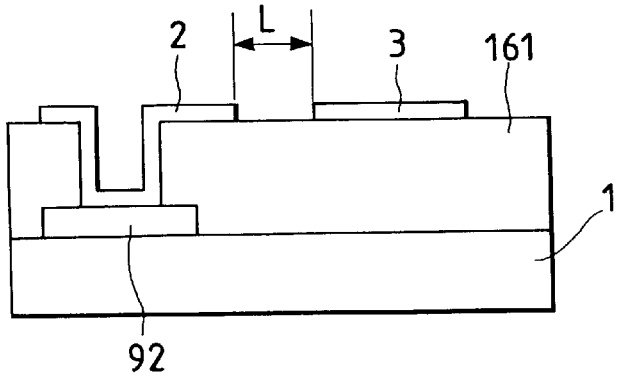

Step-d (FIG. 17D)

Thereafter, a pattern of photoresist (RD-2000N-41: available from Hitachi Chemical Co., Ltd.) was formed for pairs of device electrodes 2 and 3 and a gap separating the respective pairs of electrodes and then Ti and Ni were sequentially deposited thereon respectively to thicknesses of 5 nm and 0.1 μm by vacuum evaporation. The photoresist pattern was dissolved by an organic solvent and the Ni/Ti deposit film was treated by using a lift-off technique to produce pairs of device electrodes 2 and 3, each pair having a width W=0.3 mm and separated from each other by a distance L=3 m.

Figure 17E:
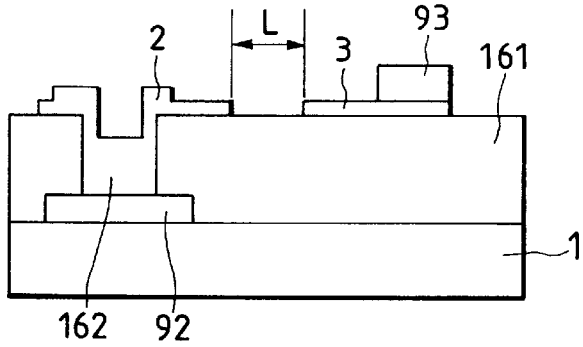

Step-e (FIG. 17E)

After forming a photoresist pattern on the device electrodes 2 and 3 for upper wires 93, Ti and Au were sequentially deposited by vacuum evaporation to respective thicknesses of 5 nm and 0.5 μm and then unnecessary areas were removed by means of a lift-off technique to produce upper wires 93 having a desired profile.

Figure 17F:
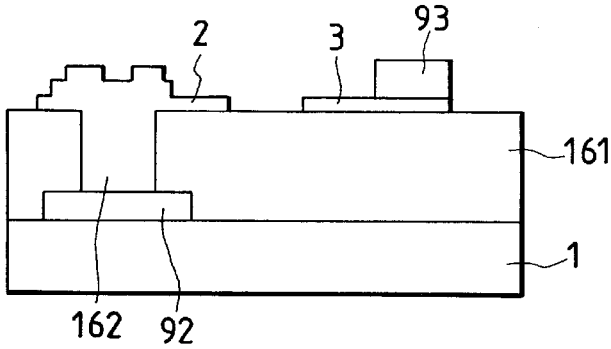

Step-f (FIG. 17F)

Then, a pattern was prepared to apply photoresist to the entire surface area of the substrate except the contact holes and subsequently, Ti and Au were sequentially deposited by vacuum deposition to respective thicknesses of 5 nm and 0.5 μm. Any unnecessary areas were removed by means of a lift-off technique to consequently bury the contact holes 162.

Figure 17G:
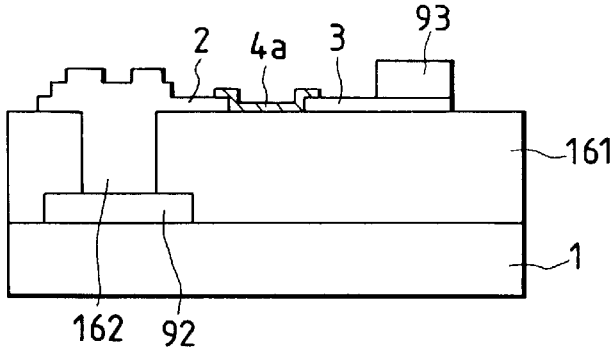

Step-g (FIG. 17G)

An organic film 4*a* was formed on the substrate carrying thereon a pair of device electrodes 2 and 3 in a manner as described below.

1 g of ethylene glycol, 0.005 g of polyvinylalcohol and 25 g of IPA were added to 3.2 g of palladium acetate monoethanolamine to prepare 100 g of an aqueous solution thereof, the balance being water. The solution was then applied to a desired location, or the location indicated in FIG. 17F, by means of a bubble-Jet type ink-jet apparatus. For comparison, an organic Pd film was formed on a quartz substrate and dried under the same conditions and thereafter this specimen was tested for the sheet resistance, which was found too high to be measured by the test although obviously it was at least greater than $10^8$ Ω/□. Another specimen was prepared under the same conditions and thereafter baked at 350° C. for 15 minutes to find that the formed film contained Pd as the principal ingredient and had a film thickness of 120 nm and a sheet resistance of $1.5\times10^2$ Ω/□.

At this stage of operation, the substrate 1 carried thereon a pair of device-electrodes 2 and 3 and an organic metal film 4*a* for each device.

Figure 17H:
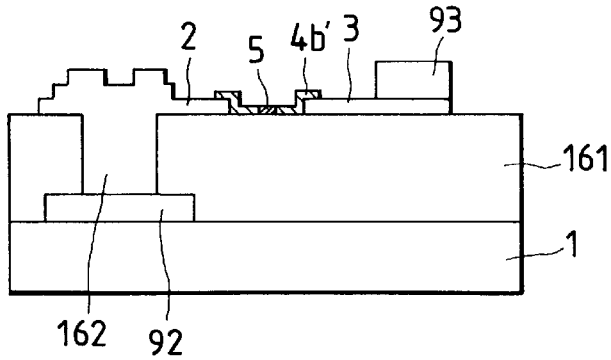
Figure 18:
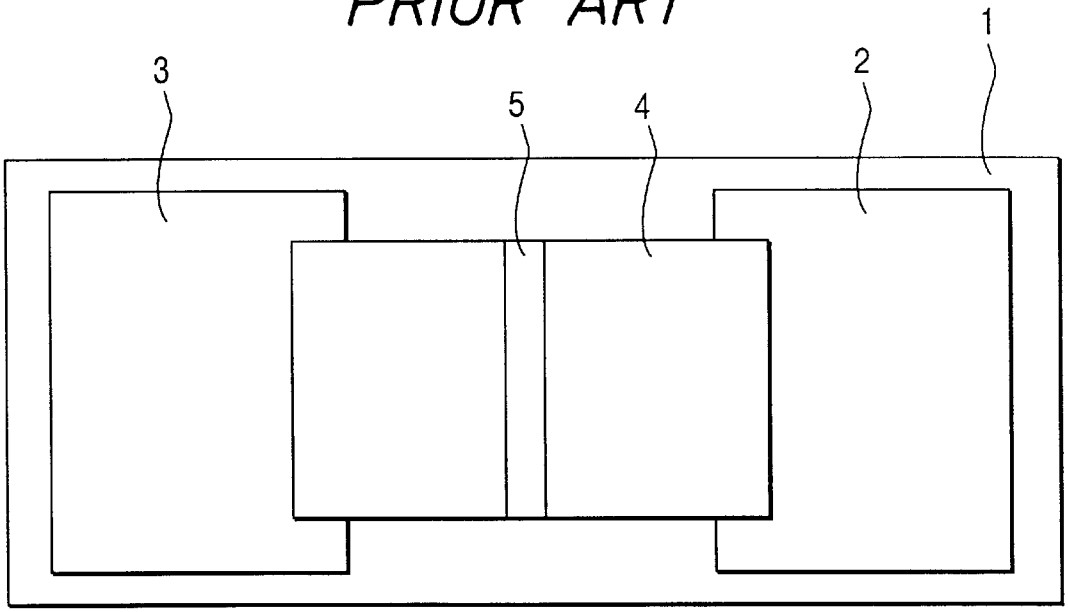
FIG. 18 PRIOR ART
FIG. 18 is a schematic plan view of a known surface conduction electron-emitting device.
Figure 19:
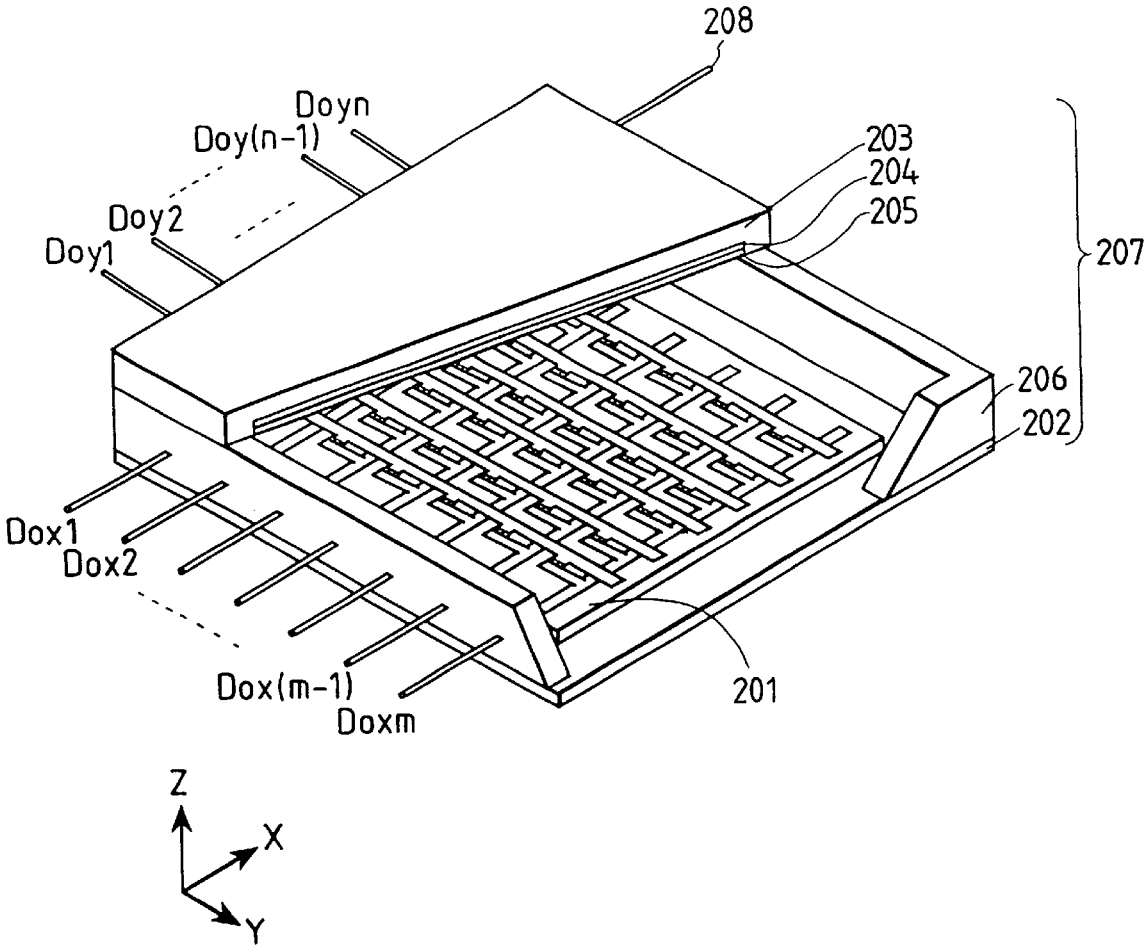
FIG. 19 PRIOR ART
FIG. 19 is a partly cut away schematic perspective view of a display panel comprising known surface conduction electron-emitting devices.

Step-h (FIG. 17H)

Then, the substrate 1 was moved into a clean oven and subjected to an energization forming process by raising the temperature from room temperature to 350° C. at a rate of 10° C./min, while applying a device voltage +Vf to the electron-emitting device from a power source (not shown). The application of the voltage was continued for 15 minutes after the temperature had reached to 350° C. and, after the termination of the voltage application, the specimen was left there to allow it to be cooled by itself to room temperature. FIG. 3A schematically illustrates the waveform of the voltage Vf used for energization forming.

In this embodiment, T1 and T2 were 1 mesc and 10 mesc respectively. The wave height of the triangular pulse voltage was 12 V.

According to the present invention, the power consumption rate for energization forming is far less than that of any known energization forming techniques and hence the load of the power source and the related wires is significantly reduced so that a large number of electron-emitting devices may be subjected to an energization forming process simultaneously.

At this stage of operation, the substrate 1 carried thereon lower wires 92, interlayer insulation layers 161, upper wires 93, device electrodes 2 and 3 and electroconductive films 4*b*.

Then, an image-forming apparatus was prepared by using the electron source. This will be described by referring to FIGS. 9 and 10.

The substrate 1 carrying thereon a large number of plane type surface conduction electron-emitting devices was rigidly fitted to a rear plate 101 and thereafter a face plate 106 (prepared by forming a fluorescent film 104 and a metal back 105 on a glass substrate 103) was arranged 5 mm above the substrate 1 by interposing a support frame 102 therebetween. Frit glass was applied to junction areas of the face plate 106, the support frame 102 and the rear plate 101, which were then baked at 400° C. for 10 minutes in the atmosphere and bonded together to a hermetically sealed condition (FIG. 10). The substrate 1 was also firmly bonded to the rear plate 101 by means of frit glass.

In FIG. 10, there are shown electron-emitting devices 94 and X- and Y-wires 92 and 93.

While the fluorescent film 104 may be solely made of fluorescent bodies if the image-forming apparatus is for black and white pictures, in this example black stripes were arranged and then the gaps separating the black stripes were filled with respective phosphor substances for the primary colors to produce a fluorescent film 104. The black stripes were made of a popular material containing graphite as a principal ingredient. The phosphor substances were applied to the glass substrate 103 by using a slurry method.

A metal back 105 is normally arranged on the inner surface of the fluorescent film 104. In this example, a metal back was prepared by producing an Al film by vacuum deposition on the inner surface of the fluorescent film 104 that had been smoothed (in a so-called filming process).

The face plate 106 may be additionally provided with transparent electrodes (not shown) arranged close to the outer surface of the fluorescent film 104 in order to improve the conductivity of the fluorescent film 104, no such electrodes were used in this example because the metal back proved to be sufficiently conductive.

The pieces of phosphor substances were carefully aligned with the respective electron-emitting devices before the above described bonding operation.

The prepared glass container (to be referred to as "panel" hereinafter) was then evacuated by means of an exhaust pipe (not shown) and an exhaust pump to achieve a sufficient degree of vacuum inside the panel. Subsequently, acetone was introduced into the panel by opening the slow leak valve until the total pressure rose to $1.3\times10^{-3}$ Pa, which pressure was then maintained. A triangular pulse voltage with a height of 14 V as shown in FIG. 3A was applied to the device electrodes 3 of the devices that had been treated for energization forming. In this step, T1 and T2 were respectively 1 mesc and 10 msec and the voltage application was terminated 30 minutes after the start. Then, the slow leak valve was closed to finish the activation process.

The panel was then heated to 300° C. for 24 hours in order to eliminate any organic substances that can contaminate the electron-emitting devices and evacuated to about $10^{-7}$ Pa. Then, the exhaust pipe (not shown) was fused by means of a gas burner to hermetically seal the panel.

Finally, a getter operation was carried out in order to maintain a high degree of vacuum in the glass container.

The finished image-forming apparatus was operated by applying a scan signal and a modulation signal to each electron-emitting device by way of the external terminals Dox1 through Doxm and doy1 through Doyn to cause the electron-emitting devices to emit electrons. Meanwhile, a high voltage of greater than several kV was applied to the metal back 105 or the transparent electrode (not shown) by way of a high voltage terminal Hv to accelerate electron beams and cause them to collide with the fluorescent film 104, which by turn was energized to emit light to display intended images.

The image-forming apparatus of the example operated stably for a long period of time to display excellent images.

Example 10

In this example, a display apparatus for displaying various image data offered from a variety of image data sources and including television programs was prepared by using the image-forming apparatus of Example 8 shown in FIG. 10 in combination with a drive circuit as shown in FIG. 12. The display apparatus was adapted to television signals of the NTSC system.

A display panel that utilizes an image-forming apparatus according to the invention and comprising an electron source of surface conduction electron-emitting devices can be made very thin and very large to advantageously provide a large screen having wide viewing angle that makes the viewer feel as if he or she is located within the scene on the display panel.

As a matter of fact, the image display of this example operated stably for a long period of time to display excellent images.

As described above in detail, a surface conduction electron-emitting device according to the invention can withstand processes that may be conducted at high temperature and therefore operates stably of a prolonged period of time for electron emission.

An electron source according to the invention and comprising a large number of such surface conduction electron-emitting devices may be so configured that the electron-emitting devices are arranged in a plurality of rows and connected with wires at the opposite ends of each device and a modulation means is provided or so that m X-directional wires and n Y-directional wires are arranged on the substrate and insulated from each other to form a matrix of wires and electron-emitting devices. In either case, each of the electron-emitting devices of the electron source can operate stably for a prolonged period of time of electron emission.

Finally, an image-forming apparatus according to the invention comprises an image-forming member and an electron source to produce images according to input signals. Such an image-forming apparatus also operates stably of a prolonged period of time for electron emission and hence a high quality image display such as a flat color television set can be realized by using an image-forming apparatus according to the invention.

What is claimed is:

1. A method of manufacturing an electron-emitting device having an electroconductive film including an electron-emitting region and a pair of device electrodes disposed opposite to each other and electrically connected to the electroconductive film, characterized in that it comprises steps of:

(a) producing a film of an organic metal compound or a complex as a precursor of the material of the electroconductive film to link the device electrodes; and (b) turning the film of the organic metal compound or the complex into an electroconductive film including an electron-emitting region by keeping the temperature of the film above the decomposition temperature of the organic metal compound or the complex and applying a voltage to the film of the organic metal compound or the complex by way of the device electrodes.

2. A method of manufacturing an electron-emitting device having an electroconductive film including an electron-emitting region and a pair of device electrodes disposed opposite to each other and electrically connected to the electroconductive film, characterized in that it comprises steps of:

forming a first electroconductive film;

forming a fissure in part of the first electroconductive film, subsequently producing a film of an organic metal compound or a complex on the first electroconductive film; and turning the film of the organic metal compound or the complex into a second electroconductive film including an electron-emitting region by keeping the temperature of the film above the decomposition temperature of the organic metal compound or the complex and applying a voltage to the film of the organic metal compound or the complex by way of the device electrodes.

3. A method of manufacturing an electron-emitting device according to claim 2, characterized in that said step of forming a fissure in part of the first electroconductive film is conductived by applying a pulse voltage between the device electrodes.

4. A method of manufacturing an electron-emitting device according to claim 1, wherein said step of turning the film of the organic metal compound or the complex into an electroconductive film is conducted in an inert gas atmosphere or in a vacuum.

5. A method of manufacturing an electron-emitting device according to claim 1, wherein said step of turning the film of the organic metal compound or the complex into an electroconductive film is conducted in an atmosphere containing an organic substance.

6. A method of manufacturing an electron-emitting device according to claim 2, further comprising the step of forming a film containing carbon as a main component on the electroconductive film containing said electron-emitting region.

7. A method of manufacturing an electron-emitting device according to claim 6, wherein said step of forming a film containing carbon as a main component comprises applying voltage to the electroconductive film containing said electron emitting region in an atmosphere containing an organic substance.

8. A method of manufacturing an electron-emitting device according to claim 2, wherein said step of turning the film of the organic metal compound or the complex into an electroconductive film is conducted in an inert gas atmosphere or in a vacuum condition.

9. A method of manufacturing an electron-emitting device according to claim 2, wherein said step of turning the film of the organic metal compound or the complex into an electroconductive film is conducted in an atmosphere containing an organic substance.

10. A method of manufacturing an electron-emitting device according to claim 1, further comprising the step of forming a film containing carbon as a main component on the electroconductive film containing said electron-emitting region.

11. A method of manufacturing an electron-emitting device according to claim 10, wherein said step of forming a film containing carbon as a main component comprises applying voltage to the electroconductive film containing said electron-emitting region in an atmosphere containing an organic substance.

12. A method of manufacturing an electron-emitting device having a pair of electrodes spaced apart and an electroconductive film, including an electron-emitting region, provided between said pair of electrodes, comprising the steps of:

forming a film composed of a compound containing metal between said pair of electrodes; and applying voltage to said film composed of the compound containing metal, while heating the film composed of said compound containing metal and effecting decomposition of said compound containing metal over the entire film composed of the compound containing metal.

13. A method of manufacturing on a substrate an electron source having plural electron-emitting devices, each electron emitting device comprising a pair of spaced-apart electrodes and an electroconductive film including an electron-emitting region provided between said pair of electrodes, wherein said plural electron-emitting devices are prepared according to claim 12.

14. A method of manufacturing an image forming device, said method comprising:

providing an electron source, said electron source comprising plural electron-emitting devices on a substrate, each electron-emitting device comprising a pair of spaced apart electrodes and an electroconductive film including an electron-emitting region provided between said pair of electrodes; and providing an image-forming member that forms an image through emission of electrons from said electron source, wherein said plural electron-emitting devices are prepared according to claim 12.

15. A method of manufacturing an electron source comprising plural electron-emitting devices wired in a matrix on a substrate with plural line wirings and plural row wirings, said method comprising the steps of:

forming, on the substrate, plural films which are composed of a compound containing metal and which are wired in a matrix with plural line wirings and plural row wirings; and applying a voltage to said plural films composed of the compound containing metal, while conducting heating of at least one film composed of the compound containing metal and effecting decomposition of said compound containing metal over the entire film composed of the compound containing metal.

16. A method of manufacturing an image forming device having, in a container, an electron source comprising plural electron emitting devices on a substrate, each electron emitting device comprising a pair of spaced-apart electrodes and an electroconductive film including an electron-emitting region provided between said pair of electrodes, and an image-forming member that forms an image upon emission of electrons from said electron source, said method comprising the steps of forming, on the substrate, plural films which are composed of a compound containing metal and which are wired in a matrix with plural line wirings and plural row wirings; and applying a voltage to said plural films composed of the compound containing metal, while conducting heating of at least one film composed of the compound containing the metal and effecting decomposition of said compound containing metal over the entire film composed of the compound containing metal.

17. A method of manufacturing an electron source, comprising:

arranging a plurality of electron-emitting devices on a substrate, each electron-emitting device having an electroconductive film including an electron-emitting region and a pair of device electrodes disposed opposite to each other and electrically connected to the electroconductive film, wherein the electron-emitting devices are prepared according to any one of claims 1, 2, 3, 4, 5, 6, 7, 8, 9, 10, or 11.

18. A method of manufacturing an image-forming apparatus having an electron source and an image-forming member for emitting rays of light to produce an image when the image forming member is irradiated with electron beams emitted from the electron source, said method comprising disposing said electron source and said image-forming member in a vacuum container, wherein the electron source is prepared according to claim 17.

19. A method of manufacturing an electron-emitting device having a pair of electrodes spaced apart and an electroconductive film, including an electron-emitting region, provided between said pair of electrodes, comprising the steps of:

forming a film composed of a compound containing metal between said pair of electrodes; and applying voltage to said film composed of the compound containing metal, while heating the film composed of said compound containing metal and lowering an electrical resistance of the film composed of the compound containing metal.

20. A method of manufacturing an electron source comprising plural electron-emitting devices wired in a matrix on a substrate with plural line wirings and plural row wirings, said method comprising the steps of:

forming, on the substrate, plural films which are composed of a compound containing metal and which are wired in a matrix with plural line wirings and plural row wirings; and applying a voltage to said plural films composed of the compound containing metal, while conducting heating of at least one film composed of the compound containing metal and lowering an electrical resistance of the film composed of the compound containing metal.

21. A method of manufacturing an image forming device having, in a container, an electron source comprising plural electron emitting devices on a substrate, each electron emitting device comprising a pair of spaced-apart electrodes and an electroconductive film including an electron-emitting region provided between said pair of electrodes, and an image-forming member that forms an image upon emission of electrons from said electron source, said method comprising the steps of:

forming, on the substrate, plural films which are composed of a compound containing metal and which are wired in a matrix with plural line wirings and plural row wirings; and applying a voltage to said plural films composed of the compound containing metal, while conducting heating of at least one film composed of the compound containing the metal and lowering an electrical resistance of the film composed of the compound containing metal.

22. A method of manufacturing an electron-emitting device according to claim 12, further comprising the step of forming a film containing carbon as a main component on the electroconductive film containing said electron-emitting region.

23. A method of manufacturing an electron-emitting device according to claims 22, wherein said step of forming a film containing carbon as a main component comprises applying voltage to the electroconductive film containing said electron-emitting region in an atmosphere containing an organic substance.

24. A method of manufacturing an electron source according to claim 15, further comprising the step of forming a film containing carbon as a main component on the electroconductive film containing said electron-emitting region.

25. A method of manufacturing an electron source according to claim 24, wherein said step of forming a film containing carbon as a main component comprises applying voltage to the electroconductive film containing said electron-emitting region in an atmosphere containing an organic substance.

26. A method of manufacturing an image forming device according to claim 16, further comprising the step of forming a film containing carbon as a main component on the electroconductive film containing said electron-emitting region.

27. A method of manufacturing an image forming device according to claim 26, wherein said step of forming a film containing carbon as a main component comprises applying voltage to the electroconductive film containing said electron-emitting region in an atmosphere containing an organic substance.

28. A method of manufacturing an electron-emitting device according to claim 19, further comprising the step of forming a film containing carbon as a main component on the electroconductive film containing said electron-emitting region.

29. A method of manufacturing an electron-emitting device according to claim 28, wherein said step of forming a film containing carbon as a main component comprises applying voltage to the electroconductive film containing said electron-emitting region in an atmosphere containing an organic substance.

30. A method of manufacturing an electron source according to claim 20, further comprising the step of forming a film containing carbon as a main component on the electroconductive film containing said electron-emitting region.

31. A method of manufacturing an electron source according to claim 30, wherein said step of forming a film containing carbon as a main component comprises applying voltage to the electroconductive film containing said electron-emitting region in an atmosphere containing an organic substance.

32. A method of manufacturing an image forming device according to claim 21, further comprising the step of forming a film containing carbon as a main component on the electroconductive film containing said electron-emitting region.

33. A method of manufacturing an image forming device according to claim 32, wherein said step of forming a film containing carbon as a main component comprises applying voltage to the electroconductive film containing said electron-emitting region in an atmosphere containing an organic substance.

* * * * *

UNITED STATES PATENT AND TRADEMARK OFFICE

CERTIFICATE OF CORRECTION

PATENT NO. : 6,334,803 B1
DATED : January 1, 2002
INVENTOR(S) : Masaaki Shibata

It is certified that error appears in the above-identified patent and that said Letters Patent is hereby corrected as shown below:

Title page,
Item [56], References Cited, FOREIGN PATENT DOCUMENTS, "7235255" should read -- 7-235255 --.
Item [57], ABSTRACT,
Line 3, "electrode" should read -- electrodes --.

Column 1,
Line 15, "device;" should read -- devices; --;
Lines 22, 27 and 30, "device" should read -- devices --;
Line 34, "apparatus" should read -- apparatuses --; and
Line 52, "apparatus." should read -- apparatuses. --.

Column 6,
Line 46, "If" should read -- If, --; and
Line 47, "with" should be deleted.

Column 9,
Line 65, "location" should read -- locations --.

Column 10,
Line 16, "10 μsec" should read -- 1 μsec and 10 msec --; and
Line 24, "triangle" should read -- triangular --.

Column 13,
Line 11, "electron emitting" should read -- electron emitting --.

Column 17,
Line 28, "pictures" should read -- pictures, --.

Column 22,
Line 22, "the" (second occurrence) should read -- of the --; and
Line 41, "0.10" should read -- 0.1 --.

Column 25,
Line 21, "s ample" should read -- sample --;
Line 55, "the" (second occurrence) should read -- of the --.

UNITED STATES PATENT AND TRADEMARK OFFICE

CERTIFICATE OF CORRECTION

PATENT NO. : 6,334,803 B1
DATED : January 1, 2002
INVENTOR(S) : Masaaki Shibata

It is certified that error appears in the above-identified patent and that said Letters Patent is hereby corrected as shown below:

Column 26,
Line 39, “bubble-Jet” should read -- bubble-jet --; and
Line 40, “ink-Jet” should read -- ink-jet --.

Column 30,
Line 25, “at” should read -- to --; and
Line 26, “to” (first occurrence) should read -- at --.

Column 31,
Line 16, “5. Step-d)” should read -- 5. ¶ Step-d) --.

Column 32,
Line 56, “Step-e) Thereafter,” should read -- Step-e) ¶ Thereafter, --;
Line 60, “at” should read -- to --; and
Line 61, “to” should read -- at --.

Column 33,
Line 56, “to” should read -- at --.

Column 34,
Line 9, “The-conditions” should read -- The conditions --.

Column 35,
Line 10, “to” (first occurrence) should read -- at --.

Column 36,
Line 39, “L = 3 m.” should read -- L = 3 μm. --.

Column 38,
Line 63, “ture” should read -- tures --; and
Line 64, “for” should read -- of --.

Column 39,
Line 13, “for” should read -- of --; and
Line 56, “conductived” should read -- conducted --.

UNITED STATES PATENT AND TRADEMARK OFFICE

CERTIFICATE OF CORRECTION

PATENT NO. : 6,334,803 B1
DATED : January 1, 2002
INVENTOR(S) : Masaaki Shibata

It is certified that error appears in the above-identified patent and that said Letters Patent is hereby corrected as shown below:

Column 41,
Line 20, “of” should read -- of: --; and
Line 46, “comprising” should read -- comprising: --.

Column 42,
Line 35, “claims” should read -- claim --.

Signed and Sealed this

Fifth Day of November, 2002

*Attest:*

*Attesting Officer*

JAMES E. ROGAN
*Director of the United States Patent and Trademark Office*